US007903993B2

(12) United States Patent
Sakagawa et al.

(10) Patent No.: US 7,903,993 B2
(45) Date of Patent: Mar. 8, 2011

(54) IMAGE FORMING APPARATUS

(75) Inventors: Yoshio Sakagawa, Hyogo (JP); Tetsumaru Fujita, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 555 days.

(21) Appl. No.: 11/972,154

(22) Filed: Jan. 10, 2008

(65) Prior Publication Data

US 2008/0181654 A1 Jul. 31, 2008

(30) Foreign Application Priority Data

Jan. 24, 2007 (JP) ..... 2007-014207

(51) Int. Cl.
*G03G 15/00* (2006.01)

(52) U.S. Cl. ..... 399/89; 399/50; 399/71; 399/176; 399/354

(58) Field of Classification Search ..... 399/50, 399/71, 89, 99, 100, 115, 123, 149, 150, 399/168, 176, 343, 353, 354, 358, 359; 15/256.5, 15/256.51, 256.52
See application file for complete search history.

(56) References Cited

U.S. PATENT DOCUMENTS 6,292,640 B1 * 9/2001 Suzuki ..... 399/175
6,799,012 B2 * 9/2004 Shakuto et al. ..... 399/357
2003/0039494 A1 * 2/2003 Shakuto et al. ..... 399/357
2007/0065179 A1 3/2007 Fujita
2007/0172259 A1 7/2007 Fujita
2007/0280735 A1 12/2007 Nagatomo et al.

FOREIGN PATENT DOCUMENTS

JP 58023075 A * 2/1983
JP 6-102800 4/1994

OTHER PUBLICATIONS

U.S. Appl. No. 12/187,021, filed Aug. 6, 2008, Shono, et al.
U.S. Appl. No. 12/204,083, filed Sep. 4, 2008, Fujita, et al.

* cited by examiner

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

An image forming apparatus capable of maintaining cleaning performance of a cleaning brush and downsizing the apparatus main body. Transfer residual toner accumulated on the cleaning brush is transferred onto a photoreceptor by an electrostatic force, hence the cleaning brush becomes clean and the cleaning performance thereof improves. Therefore, the photoreceptor and a charging roller can be cleaned well by the cleaning brush over a long period of time, and the photoreceptor can be charged well by the charging roller over a long period of time. Moreover, because the transfer residual toner that is transferred from the cleaning brush onto the photoreceptor is recovered by a developing device, it is not necessary to provide the apparatus main body with a toner recovery portion that is specially designed for recovering the transfer residual toner, hence the apparatus main body can be downsized.

20 Claims, 14 Drawing Sheets

| LINEAR VELOCITY RATIO | 0.05 | 0.1 | 0.5 | 0.9 | 1.5 | 2.5 |
|---|---|---|---|---|---|---|
| LINEAR VELOCITY OF CLEANING BRUSH [mm/s] | 5 | 10 | 50 | 90 | 150 | 250 |
| DISCHARGE RATE [%] | 5 | 50 | 30 | 15 | 5 | 5 |

FIG. 8

| POTENTIAL AT THE TIME OF RECOVERY [V] | | | | POTENTIAL AT THE TIME OF DISCHARGE [V] | | | POTENTIAL GAP AT THE TIME OF RECOVERY [V] | | | POTENTIAL GAP AT THE TIME OF DISCHARGE [V] | | | CONTACT STATE OF CLEANING BRUSH | | EVALU-ATION |
|---|---|---|---|---|---|---|---|---|---|---|---|---|---|---|---|
| PHOTO-RECEP-TOR | PHOTO-RECEP-TOR (A) | CHARGING ROLLER (B) | CLEAN-ING BRUSH (C) | PHOTO-RECEP-TOR (A) | CHARGING ROLLER (B) | CLEAN-ING BRUSH (C) | (C) − (A) | (B) − (A) | (C) − (B) | (A) − (C) | (A) − (B) | (B) − (C) | CON-TACTING WITH PHOTO-RECEPTOR | CON-TACTING WITH CHARGING ROLLER | CHARGED STATE WITH MAKING 1000 PRINTS |
| 1 | 0 | −500 | 100 | 0 | −800 | −1,000 | +100 | −500 | +600 | +1000 | +800 | +200 | CON-TACTING | CON-TACTING | ○ |
| 2 | | | | | | | | | | | | | NOT CON-TACTING | CON-TACTING | △ |
| 3 | | | | | | | | | | | | | CON-TACTING | NOT CON-TACTING | × |
| 4 | | | | 0 | −800 | −600 | | | | +600 | +800 | −200 | CON-TACTING | CON-TACTING | × |
| 5 | 0 | −500 | −200 | 0 | −800 | −1,000 | −200 | −500 | +300 | +1000 | +800 | +200 | CON-TACTING | CON-TACTING | × |
| 6 | 0 | −600 | 200 | | | | +200 | −600 | +800 | | | | CON-TACTING | CON-TACTING | ○ |
| 7 | 0 | −500 | 200 | 0 | −600 | −900 | +200 | −500 | +700 | +900 | +600 | +300 | CON-TACTING | CON-TACTING | ○ |

FIG. 16

| POTENTIAL AT THE TIME OF PRINT JOB [V] | | | POTENTIAL AT THE TIME OF NON-PRINT JOB [V] | | | CONTACT STATE OF CLEANING BRUSH | | ON CLEANING BRUSH | EVALUATION | |
|---|---|---|---|---|---|---|---|---|---|---|
| PHOTO-RECEPTOR | CHARGING ROLLER | CLEANING BRUSH | PHOTO-RECEPTOR | CHARGING ROLLER | CLEANING BRUSH | CON-TACTING WITH PHOTO-RECEPTOR | CON-TACTING WITH CHARGING ROLLER | CONDUCTIVE SHEET | CHARGED STATE WHEN MAKING 1000 PRINTS | CHARGED STATE WHEN MAKING 2000 PRINTS |
| 0 | -500 | 200 | 0 | -600 | -900 | CON-TACTING | CON-TACTING | × | ○ | × |
| | | | | | | | | ○ | ○ | ○ |

FIG. 18

| SAMPLES | POTENTIAL AT THE TIME OF PRINT JOB [V] | | | POTENTIAL AT THE TIME OF NON-PRINT JOB [V] | | | CONTACT STATE OF CLEANING BRUSH | | ON PHOTO-RECEPTOR | EVALUATION | |
|---|---|---|---|---|---|---|---|---|---|---|---|
| | PHOTO-RECEPTOR | CHARGING ROLLER | CLEANING BRUSH | PHOTO-RECEPTOR | CHARGING ROLLER | CLEANING BRUSH | CON-TACTING WITH PHOTO-RECEPTOR | CON-TACTING WITH CHARGING ROLLER | CON-DUCTIVE SHEET | CHARGED STATE WHEN MAKING 1000 PRINTS | CHARGED STATE WHEN MAKING 2000 PRINTS |
| 7 | 0 | -500 | 200 | 0 | -600 | -900 | CON-TACTING | CON-TACTING | × | ○ | × |
| 9 | | | | | | | | | ○ | ○ | ○ |

IMAGE FORMING APPARATUS

BACKGROUND OF THE INVENTION

1. Field of the Invention

The present invention relates to an image forming apparatus, such as a printer, a copying machine, and a facsimile device. More specifically, the present invention relates to an image forming apparatus that uses a cleaning member to recover transfer residual toners adhered to the surface of an image carrier and the surface of a charging member charging the image carrier, after a toner image is transferred onto a transfer body.

2. Description of the Related Art

There has conventionally been known an image forming apparatus using a system for charging a photoreceptor by bringing a charging roller applied with a voltage into contact with the surface of the photoreceptor. In such an image forming apparatus, because the charging roller is in contact with the photoreceptor, the toner that remains on the photoreceptor surface after it is cleaned by a cleaning brush or the like adheres to the surface of the charging roller. If the toner adheres to the surface of the charging roller as described above, the part carrying the toner cannot charge the photoreceptor properly, causing uneven charging of the photoreceptor surface. For this reason, the toner adhered to the surface of the charging roller needs to be removed.

In the image forming apparatus disclosed in, for example, Japanese Published Unexamined Patent Application No. H6-102800, the cleaning brush for removing the toner remaining on the photoreceptor surface is brought into contact with not only the photoreceptor surface but also the surface of the charging roller in order to remove the toner adhered to the surface of the charging roller as well.

In recent years, the downsizing of image forming apparatuses has progressed, and, as with the image forming apparatus described in the above patent publication, the configuration of using a single cleaning brush to remove the toners adhered to the photoreceptor surface and the charging roller surface is established so that it is not necessary to provide both a cleaning brush for the photoreceptor and a cleaning brush for the charging roller, whereby the downsizing of the apparatus main body can be realized.

Note that when the toners that are adhered to the photoreceptor surface and the charging roller surface are removed using the cleaning brush, the toners gradually accumulate on the cleaning brush, reducing cleaning performance of the cleaning brush. In the image forming apparatus described in the above patent publication, therefore, in order to secure cleaning performance of the cleaning brush, a flicker bar is brought into contact with the cleaning brush to scrape off the toner adhered to the cleaning brush.

However, in the configuration of the image forming apparatus described in the above patent publication, it is necessary to provide a waste toner tank that is specially designed for recovering the toner scraped off from the cleaning brush, but the problem is that providing such a waste toner tank will increase the size of the apparatus main body.

SUMMARY OF THE INVENTION

The present invention was contrived in view of the above problems, and it is an object of the present invention to provide an image forming apparatus that is capable of maintaining cleaning performance of a cleaning brush of the apparatus and downsizing the apparatus main body.

In an aspect of the present invention, an image forming apparatus comprises a latent image carrier that carries a latent image on an endlessly moving surface thereof; a developing device for developing the latent image carried on the latent image carrier by means of a toner; a charging member that uniformly charges the surface of the latent image carrier while endlessly moving a surface of the charging member in contact with the latent image carrier; a first bias supply device for supplying a bias to the charging member; a cleaning member that recovers at least toners adhered to the surfaces of the latent image carrier and the charging member, while endlessly moving a surface of the cleaning member in contact with the latent image carrier and the charging member on an upstream side in a latent image carrier rotational direction in relation to the charging member, to clean the surfaces of the latent image carrier and the charging member; and a second bias supply device for supplying a bias to the cleaning member. At least one of the followings is performed: supplying a bias from the second bias supply device to the cleaning member to transfer the toners from the cleaning member to a non-image area on the latent image carrier surface such as to transfer the toners directly from the cleaning member to the non-image area by means of an electrostatic force, the toners being recovered from the latent image carrier and the charging member to the cleaning member; and supplying a bias from the first bias supply device to the charging member, and supplying a bias from the second bias supply means to the cleaning member, to transfer the recovered toners from the cleaning member to the non-image area such as to transfer the toners from the cleaning member to the non-image area via the charging member. The toners that are transferred to the non-image area are recovered by the developing device.

BRIEF DESCRIPTION OF THE DRAWINGS

The above and other objects, features and advantages of the present invention will become more apparent from the following detailed description taken with the accompanying drawings, in which:

FIG. 8 is a table showing results of experiments of Example 1;

FIG. 16 is a table showing results of Experiment 2 in Example 3 according to the present embodiment;

FIG. 18 is a table showing results of Experiment 3 in Example 3.

DESCRIPTION OF THE PREFERRED EMBODIMENT(S)

In the present invention, at least one of the followings is performed: supplying a bias from second bias supply means to a cleaning member to transfer toners from the cleaning member to a non-image area such as to transfer the toners directly from the cleaning member to the non-image area by means of an electrostatic force, the toners being recovered from a latent image carrier and a charging member to the cleaning member; and supplying a bias from first bias supply means to the charging member, and supplying a bias from the second bias supply means to the cleaning member, to transfer the recovered toners from the cleaning member to the non-image area such as to transfer the toners from the cleaning member to the non-image area via the charging member. Accordingly, the toners recovered by the cleaning member are transferred from the cleaning member to the abovementioned non-image area, that is, a latent image carrier surface by an electrostatic force, hence the cleaning member becomes clean, and the cleaning performance of the cleaning member improves. Also, because the toner transferred from the cleaning member to the latent image carrier surface is recovered by developing means, it is not necessary to provide the apparatus main body with a toner recovery portion that is specially designed for recovering the toner. Therefore, the apparatus main body can be downsized.

An embodiment of an electrophotographic color laser printer (simply called "printer" hereinafter) will be described hereinafter as an image forming apparatus to which the present invention is applied.

First of all, the basic configuration of the printer according to the present embodiment will be described.

Figure 1:
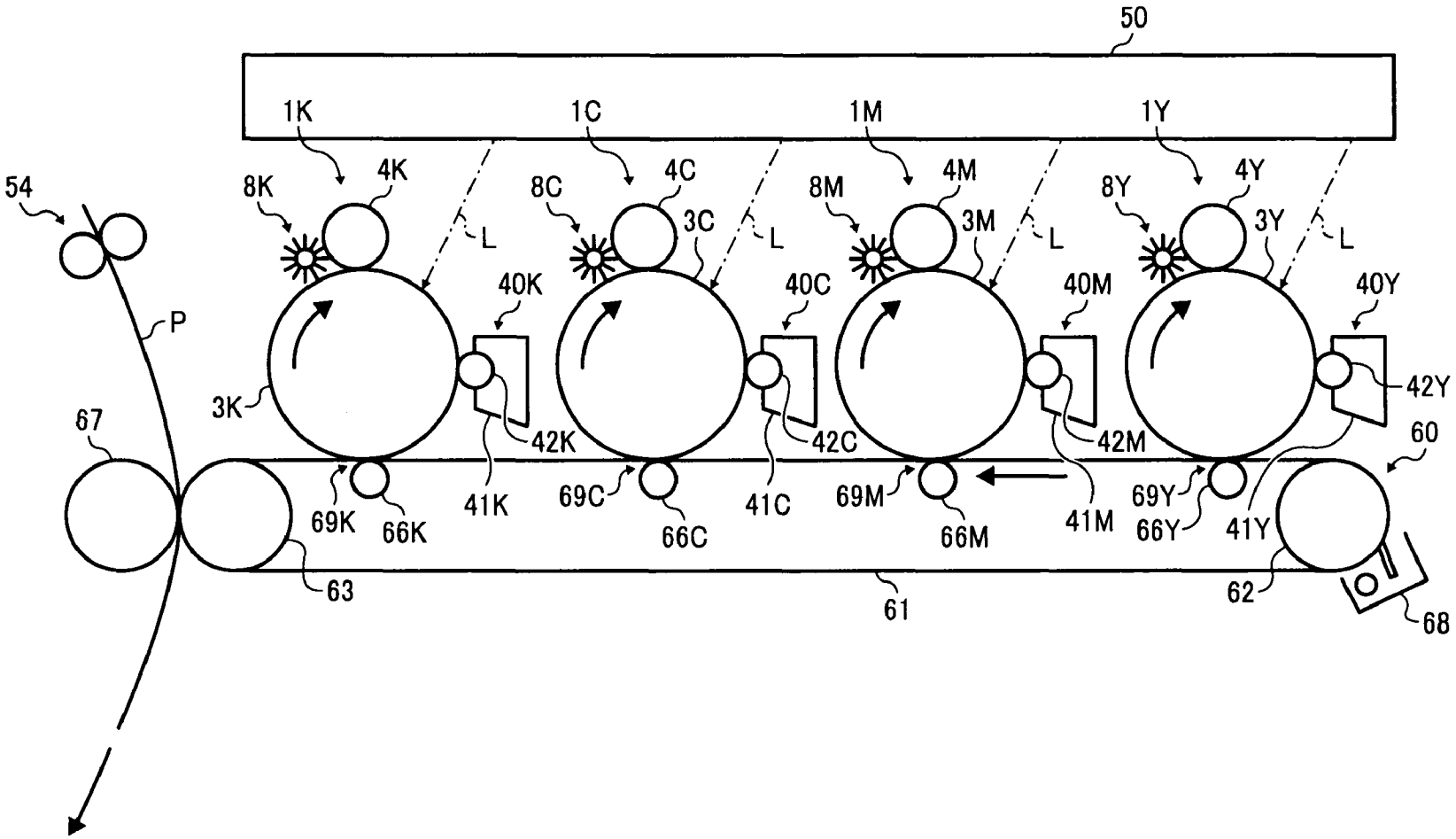
FIG. 1 is a view showing a schematic configuration of a printer according to an embodiment of the present invention.

FIG. 1 shows a schematic configuration of a substantial part of the printer according to the present embodiment. This printer has four process units 1Y, M, C and K for forming toner images of yellow, magenta, cyan and black ("Y, M, C and K," hereinafter) respectively. The printer also has an optical writing unit 50, a resist roller pair 54, a transfer unit 60 and the like. The letters "Y," "M," "C," and "K" at the end of reference numerals indicate the members for yellow, magenta, cyan and black colors, respectively.

The optical writing unit 50 has light sources configured by four laser diodes corresponding to Y, M, C and K colors, a polygon mirror in the shape of a regular hexahedron, a polygon motor for rotating and driving this mirror, an f-θ lens, a lens, a reflecting mirror, and the like. Laser beams L emitted from the laser diodes are reflected by any one of the surfaces of the polygon mirror, and reach any of four photoreceptors described hereinafter, while being deflected as the polygon mirror rotates. The laser beams L emitted from the four laser diodes optically scan the surfaces of the four photoreceptors Y, M, C and K, respectively.

The process units 1Y, 1M, 1C and 1K have, respectively, drum-like photoreceptors 3Y, 3M, 3C and 3K as latent image carriers, and developing devices 40Y, 40M, 40C and 40K corresponding individually to these photoreceptors. Each of the photoreceptors 3Y, 3M, 3C and 3K is obtained by coating an aluminum pipe stock with an organic photosensitive layer, and is rotated and driven by driving means, not shown, in the clockwise direction in the drawing at a predetermined linear velocity. Then, each of the photoreceptors is subjected to optical scanning in the dark by the optical writing unit 50 emitting the laser beams L that are modified based on image information sent from an unshown personal computer or the like, whereby Y, M, C and K electrostatic latent images are carried by the respective photoreceptors.

Figure 2:
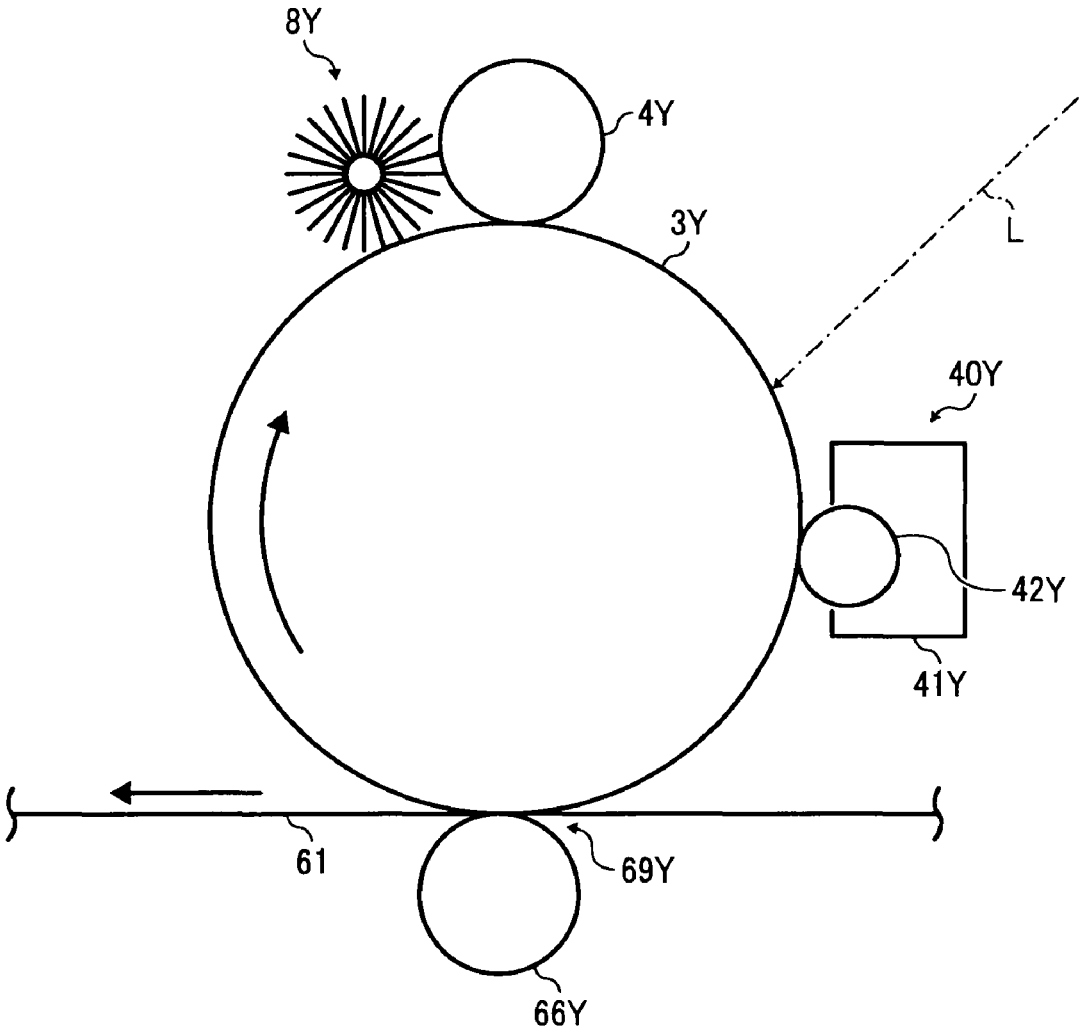
FIG. 2 is a view showing a schematic configuration of a Y process unit.
Figure 3:
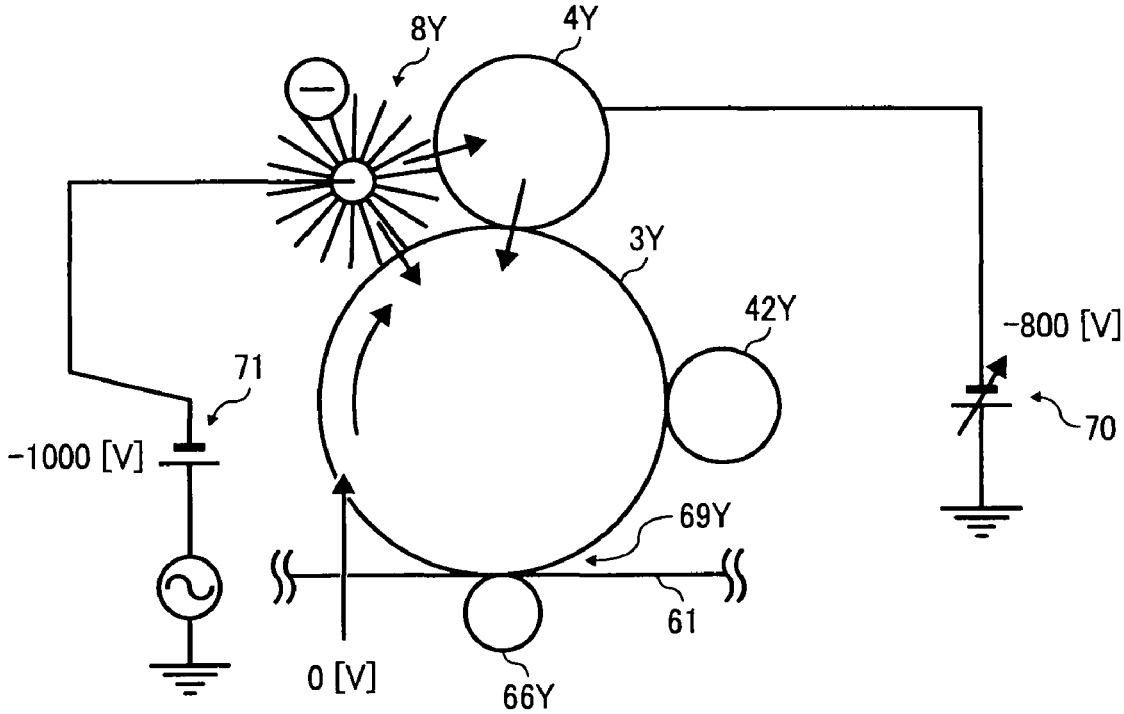
FIG. 3 is a view showing a schematic configuration of a process unit when a non-print job of Example 1 according to the present embodiment is performed.

FIG. 2 is an enlarged configuration diagram showing the Y process unit 1Y out of the four process units 1Y, 1M, 1C and 1K along with an intermediate transfer belt 61 of a transfer unit 60 shown in FIG. 3. In the drawing, the Y process unit 1Y causes a common unit casing (holding body) to hold the photoreceptor 3Y, a charging roller 4Y, a cleaning brush 8Y, an unshown destaticizing lamp, a developing device 40Y functioning as developing means, and other members as one unit, and makes this unit casing detachable with respect to the printer main body.

The Y photoreceptor 3Y, which is a body to be charged and a latent image carrier, is a drum with a diameter of approximately 24 [mm] in which a photosensitive layer made of a negatively-charged organic photoconductive material (OPC) is applied to a surface of a conductive substrate made of an aluminum pipe stock, and this drum is rotated and driven by the unshown driving means in the clockwise direction in the drawing at a predetermined linear velocity.

The charging roller 4Y has a metallic shaft that is rotatably supported by a bearing, not shown, and causes the roller surface to slide on the photoreceptor 3Y, while being rotated and driven around the shaft by driving means, not shown, in the clockwise direction in the drawing. A power supply device 70, which is charging bias supply means configured by a power supply and wires provided in the apparatus main body, is connected to the shaft, and thereby a charging bias consisting of DC voltage is applied to the shaft. In this printer, the charging roller 4Y, the unshown driving means for rotating and driving the charging roller 4Y, the abovementioned charging bias supply device and the like configure a charging system for uniformly charging the periphery of the photoreceptor 3Y. Then, an electric discharge is generated between the charging roller 4Y and the photoreceptor 3Y to uniformly charge the surface of the photoreceptor 3Y to a negative polarity. It should be noted that the charging roller 4Y of the charging system is disposed within the process unit 1Y and made integrally detachable with respect to the photoreceptor 3Y and the printer main body.

The surface of the Y photoreceptor 3Y that is charged uniformly is subjected to optical scanning by the abovementioned optical writing unit 50, whereby an electrostatic latent image is formed on the photoreceptor surface. This electrostatic latent image is developed to a Y toner image by the Y developing device 40Y.

The Y developing device 40Y has a developing roller 42Y, which is disposed so as to face the photoreceptor 3Y in a contact manner and a peripheral surface of which is partially exposed from an opening provided in a casing 41Y. This developing roller is rotated and driven by the unshown driving means. The casing 41Y contains a Y developer, not shown, which has a Y toner with a negative polarity as a main component. It should be noted that in the present embodiment a pulverized toner having a particle diameter of 8.5 [μm] is used as the developer, and 1% of HMDS-processed silica having a specific surface area of 200 [$m^2$/g] and 2% of HMDS-processed silica having a specific surface area of 90 [$m^2$/g] are externally added. The Y developer is drawn up to the developer roller surface, and, as the developer roller rotates, the thickness of the developer is regulated when the developer passes through the position where the developer roller faces a developing doctor 43Y, not shown. Thereafter, the developer is conveyed in contact with a developing area facing the photoreceptor 3Y, whereby the electrostatic latent image on the photoreceptor 3Y is developed to a toner image.

The Y toner image on the photoreceptor 3Y is intermediately transferred onto the intermediate transfer belt 61 at a Y primary transfer nip where the photoreceptor 3Y abuts against the intermediate transfer belt 61. A transfer residual toner that was not transferred onto the intermediate transfer belt 61 is adhered to the surface of the photoreceptor 3Y after it passes through the primary transfer nip. This transfer residual toner is removed from the surface of the photoreceptor 3Y by the cleaning brush 8Y that abuts against the charging roller 4Y and the photoreceptor 3Y on the upstream side in the photoreceptor rotational direction in relation to the charging roller 4Y. A small amount of transfer residual toner that could not be removed from the photoreceptor 3Y by the cleaning brush 8Y is adhered to the surface of the charging roller 4Y abutting against the photoreceptor 3Y, but this transfer residual toner adhered to the surface of the charging roller 4Y also is removed by the cleaning brush 8Y. Note that a bias is applied to the cleaning brush 8Y by a power supply device 71 provided in the apparatus main body.

A plurality of bristle fibers of the cleaning brush 8Y are obtained by cutting conductive fibers into a predetermined length. Examples of the material of the conductive fibers include nylon 6™, nylon 12™, acrylic, Teflon™, and other resins. Conductive particles such as carbon or metallic fine particles are dispersed in any of these resin materials to have electrical conductivity. Conductive fibers obtained by dispersing carbon in a nylon resin are preferred in terms of production cost and low Young's modulus. Note that carbon may be dispersed in the fibers.

The above has described the Y process unit 1Y, and explanations of the other process units 1M, 1C and 1K are omitted as they have the same configuration as the Y process unit 1Y.

In FIG. 1 described above, the transfer unit 60 is disposed below the process units 1Y, 1M, 1C and 1K of respective colors. In this transfer unit 60 the endless intermediate transfer belt 61 is tightly stretched by a plurality of stretching rollers and thereby endlessly moved in the counterclockwise direction in the drawing. The plurality of stretching rollers indicate, specifically, a driven roller 62, a driving roller 63, four primary transfer bias rollers 66Y, 66M, 66C and 66K, and the like.

The driven roller 62, the primary transfer bias rollers 66Y, 66M, 66C and 66K, and the driving roller 63 are all in contact with the rear surface (loop inner peripheral surface) of the intermediate transfer belt 61. Each of the four primary transfer bias rollers 66Y, 66M, 66C and 66K is obtained by coating a metallic cored bar with sponge or other elastic body, and is pressed against each of the photoreceptors 3Y, 3M, 3C and 3K of the respective Y, M, C and K colors to interpose the intermediate transfer belt 61 therebetween. Accordingly, the four photoreceptors 3Y, 3M, 3C and 3K come into contact with the intermediate transfer belt 61 at a predetermined length in a belt moving direction, whereby four primary transfer nips of the respective Y, M, C and K colors are formed as primary transfer portions 69.

Each of the cored bars of the four primary transfer bias rollers 66Y, 66M, 66C and 66K is applied with a primary transfer bias that is subjected to constant current control by a transfer bias power supply, which is not shown. Consequently, transfer charges are applied to the rear surface of the intermediate transfer belt 61 via the four primary transfer bias rollers 66Y, 66M, 66C and 66K, whereby a transfer electric field is formed at each primary transfer nip between the intermediate transfer belt 61 and each of the photoreceptors 3Y, 3M, 3C and 3K. Note that although this printer is provided with the primary transfer bias rollers 66Y, 66M, 66C and 66K as primary transfer means, brush-like members or blade-like members may be used in place of the rollers. Moreover, a transfer charger or the like may be used.

The Y, M, C and K toner images formed on the photoreceptors 3Y, 3M, 3C and 3K of the respective colors are stacked on the intermediate transfer belt 61 at the primary transfer nips of the respective colors, and then transferred. Consequently, a toner image of the four stacked colors is formed on the intermediate transfer belt 61 (referred to as "four-color toner image" hereinafter).

In a section of the intermediate transfer belt 61 where the driving roller 63 is stretched, a secondary transfer bias roller 67 abuts against each surface of the belt, whereby a secondary transfer nip is formed. The secondary transfer bias roller 67 is applied with a secondary transfer bias by voltage applying means configured by a power supply and wires which are not shown. Accordingly, a secondary transfer electric field is formed between the secondary transfer bias roller 67 and a grounded secondary transfer nip rear side roller 64. The four-color toner image formed on the intermediate transfer belt 61 enters the secondary transfer nip as the belt endlessly moves.

The present printer has a paper feeding cassette, not shown, for storing a plurality of recording sheets P therein in a stacked form. The top recording sheet P is sent to a paper feeding path in predetermined timing. The sent recording sheet P is sandwiched by a resist nip between the pair of resist rollers 54 disposed at the end of the paper feeding path.

The pair of resist rollers 54 are both rotated and driven to hold the recording sheet P, which is sent from the paper feeding cassette, at the resist nip, and stop their rotation and drive as soon as they hold the leading end of the recording sheet P therebetween. Then, in synchronization with the four-color toner image on the intermediate transfer belt 61, the pair of resist rollers 54 send the recording sheet P toward the secondary transfer nip. At this secondary transfer nip, the four-color toner image on the intermediate transfer belt 61 is secondarily transferred onto the recording sheet P at once by the action of the secondary transfer electric field or nip pressure, whereby a full-color image combined with the white color of the recording sheet P is formed.

The recording sheet P on which the full-color image is formed in the above manner is discharged from the secondary transfer nip and then sent to a fixing device, not shown, to thereby fix the full-color image.

The secondary transfer residual toner that is adhered to the surface of the intermediate transfer belt 61 after passing through the secondary transfer nip is removed from the belt surface by a belt cleaning device 68.

In the present printer having the above-described basic configuration, each of the four photoreceptors 3Y, M, C and K functions as a latent image carrier for carrying a latent image on the surface thereof that endlessly moves as it rotates. Moreover, the optical writing unit 50 functions as latent image forming means for forming a latent image on the surface of the uniformly charged photoreceptor. In addition, a drive source and a drive transmission system, which are configured by the motor, a row of gears and the like for rotating and driving the photoreceptors 3Y, 3M, 3C and 3K to endlessly move on the surfaces of the photoreceptors, and a drive control unit, not shown, for controlling the on/off operation of the drive source, function as latent image carrier drive means. Note that the drive control unit is configured by a known control circuit configured by a CPU and the like and information storage means such as a RAM.

Next, the characteristics of the printer according to the present embodiment will be described with reference to examples. Note that the basic configuration of the printer according to each of the examples is the same as that described above, unless otherwise stated.

Example 1

The printer according to the present example adopts a so-called "cleaner-less system" as shown in FIG. 1. This cleaner-less system is a system for executing an image formation process on the latent image carrier, such as the photoreceptor 3Y, without using special means for cleaning and recovering transfer residual toner adhered to the latent image carrier. The special means for cleaning and recovering transfer residual toner is, specifically, means for separating transfer residual toner from the latent image carrier and then recovering the transfer residual toner by conveying it to a waste toner container without causing it to adhere to the latent image carrier, or for performing recycle recovery by conveying the transfer residual toner into the developing device 40Y. A cleaning blade used for scraping off the transfer residual toner from the latent image carrier is also included in the special means.

Such a cleaner-less system will be described in detail. The cleaner-less system is largely classified into dispersing and passing type, temporary catching type, and combination type cleaner-less systems. In the dispersing and passing type cleaner-less system, a dispersing member such as a brush for rubbing the latent image carrier is used for scraping off the transfer residual toner on the latent image carrier to thereby weaken the adhesive force between the transfer residual toner and the latent image carrier. Thereafter, the transfer residual toner on the latent image carrier is electrostatically transferred to the developing roller or other developing member in a developing area where the developing sleeve, the developing roller or other developing member faces the latent image carrier, or in an area located immediately before the developing area, whereby the transfer residual toner is recovered to the developing device 40Y. Prior to this recovery, the transfer residual toner passes through an optical writing position where a latent image is written, but the latent image writing operation is not impinged as long as the amount of transfer residual toner is relatively small. However, if the transfer residual toner contains a toner that is charged to a polarity opposite to the regular polarity, the transfer residual toner is not recovered to the developing members, causing scumming. In order to prevent the occurrence of scumming caused by such oppositely charged toner, it is preferred that toner charging means for charging the transfer residual toner on the latent image carrier to the regular polarity be provided between a transfer position (e.g., the primary transfer nip) and a dispersing position obtained by the dispersing member, or between the dispersing position and the developing area. As the dispersing member, a fixing brush with a plurality of bristle fibers constituted by conductive fibers attached to a steel plate or a unit casing, a brush roller obtained by arranging a plurality of bristle fibers upright on a metallic rotational axis member, a roller member with a roller portion formed from a conductive sponge or the like, or other member can be used.

In the temporary catching type cleaner-less system, the transfer residual toner on the latent image carrier is temporarily caught by a rotating brush member or other catching member that moves endlessly while contacting with the latent image carrier at its surface. Then, upon completion of a print job or in inter-sheet timing between print jobs, the transfer residual toner on the catching member is discharged, retransferred to the latent image carrier, electrostatically transferred to the developing members such as the developing roller, and then recovered into the developing device 40Y. In the dispersing and passing type cleaner-less system described above, when an excessive amount of transfer residual toner exists, i.e., when forming a solid image or after a paper jam occurs, the developing members can no longer catch the transfer residual member, causing image deterioration. However, in the temporary catching type cleaner-less system the transfer residual toner caught by the catching member can be recovered little by little to the developing members to prevent the occurrence of image deterioration.

The combination type cleaner-less system is obtained by combining the dispersing and passing type cleaner-less system and the temporary catching type cleaner-less system. Specifically, the rotating brush member that is brought into contact with the latent image carrier is used as both the dispersing member and the catching member. By applying only DC voltage to the rotating brush member or the like, the rotating brush member or the like is caused to function as the dispersing member, and by changing the bias from DC voltage to AC voltage according to need, the rotating brush member or the like is caused to function as the catching member.

In the process unit 1Y of the present embodiment the temporary catching type cleaner-less system is adopted. During a print job in which a latent image is written by the optical writing unit 50, a transfer residual toner recovery mode is executed to catch transfer residual toners adhered to the photoreceptor 3Y and the charging roller 4Y by means of the cleaning brush 8Y in order to prevent the occurrence of a charging failure of the photoreceptor 3Y. Furthermore, upon completion of the print job or in inter-sheet timing, a transfer residual toner discharge mode is executed to transfer the transfer residual toners, which were caught by the cleaning brush 8Y, to the non-image area on the photoreceptor 3Y directly and via the charging roller 4Y in order to clean the cleaning brush 8Y. For example, during the time between when the power is turned ON and before starting a print job, during the time between formation of the previous image and formation of the next image, and during the time between when the print job is finished and before starting the next print job, the cleaning brush 8Y is cleaned in the abovementioned toner discharge mode, and the photoreceptor 3Y and the transfer roller are cleaned in the abovementioned toner recovery mode during the print job.

Specifically, the photoreceptor 3Y comes into contact with the surface of the intermediate transfer belt 61 while being rotated and driven in the clockwise direction in the drawing at a predetermined linear velocity, and thereby forms a Y primary transfer nip. Then, the transfer residual toners adhered to the photoreceptor 3Y and the charging roller 4Y after passing through the primary transfer nip are transferred to the cleaning brush 8Y by an electrostatic force or a frictional force and caught temporarily there. The optimum directions of movement of the toner between the members are shown by the arrows in FIG. 4. Note that the direction of rotation of the charging roller 4Y at this moment may be either a counter direction or a direction in which it rotates as the photoreceptor 3Y rotates. When the charging roller 4Y is rotated in the counter direction, the transfer residual toner can be scraped off from the photoreceptor 3Y more and moved to the charging roller 4Y by a large frictional force. Furthermore, the linear velocity (rotational speed) of the cleaning brush 8Y is preferably higher than the linear velocity of the photoreceptor 3Y and the linear velocity of the charging roller 4Y. For example, the linear velocity of the photoreceptor 3Y and the linear velocity of the charging roller 4Y are set to 100 [mm/s], and the linear velocity of the cleaning brush 8Y is set to 250 [mm/s], so that the ratio of the linear velocity of the cleaning brush 8Y to the linear velocity of the photoreceptor 3Y and the linear velocity of the charging roller 4Y is 2.5. Moreover, it is preferred that the cleaning brush 8Y be so configured that it can be driven independently, and the drive timing thereof may be set to the same timing as the photoreceptor 3Y and the charging roller 4Y.

At the time of a non-print job in which a latent image is not written by the optical writing unit 50, i.e., upon completion of a print job or in inter-sheet timing, the bias to be applied to the charging roller 4Y or the cleaning brush 8Y is switched to re-transfer the transfer residual toner, which was caught by the cleaning brush 8Y, to the non-image area on the photoreceptor 3Y directly or via the charging roller 4Y by means of an electrostatic force or a frictional force. The optimum directions of movement of the toner between the members are shown by the arrows in FIG. 5. Thereafter, the transfer residual toner is recovered from the photoreceptor 3Y into the developing device 40Y via the developing roller 42Y. Note that the direction of rotation of the charging roller 4Y and the direction of rotation of the cleaning brush 8Y at this moment are preferably the direction in which they rotate as the photoreceptor 3Y rotates, and the direction of rotation of the cleaning brush 8Y is preferably a counter direction to the rotational direction of the charging roller 4Y. Moreover, it is preferred to set the ratio of the linear velocity of the cleaning brush 8Y to the linear velocity of the photoreceptor 3Y at this moment to 0.1 through 0.9, or to set the ratio of the linear velocity of the cleaning brush 8Y to the linear velocity of the photoreceptor 3Y to be smaller than the ratio of the linear velocity of the charging roller 4Y to the linear velocity of the photoreceptor 3Y. By obtaining such rotation directions and the linear velocity ratio described above, the transfer residual toner caught by the cleaning brush 8Y can be discharged onto the photoreceptor 3Y efficiently.

Figure 4:
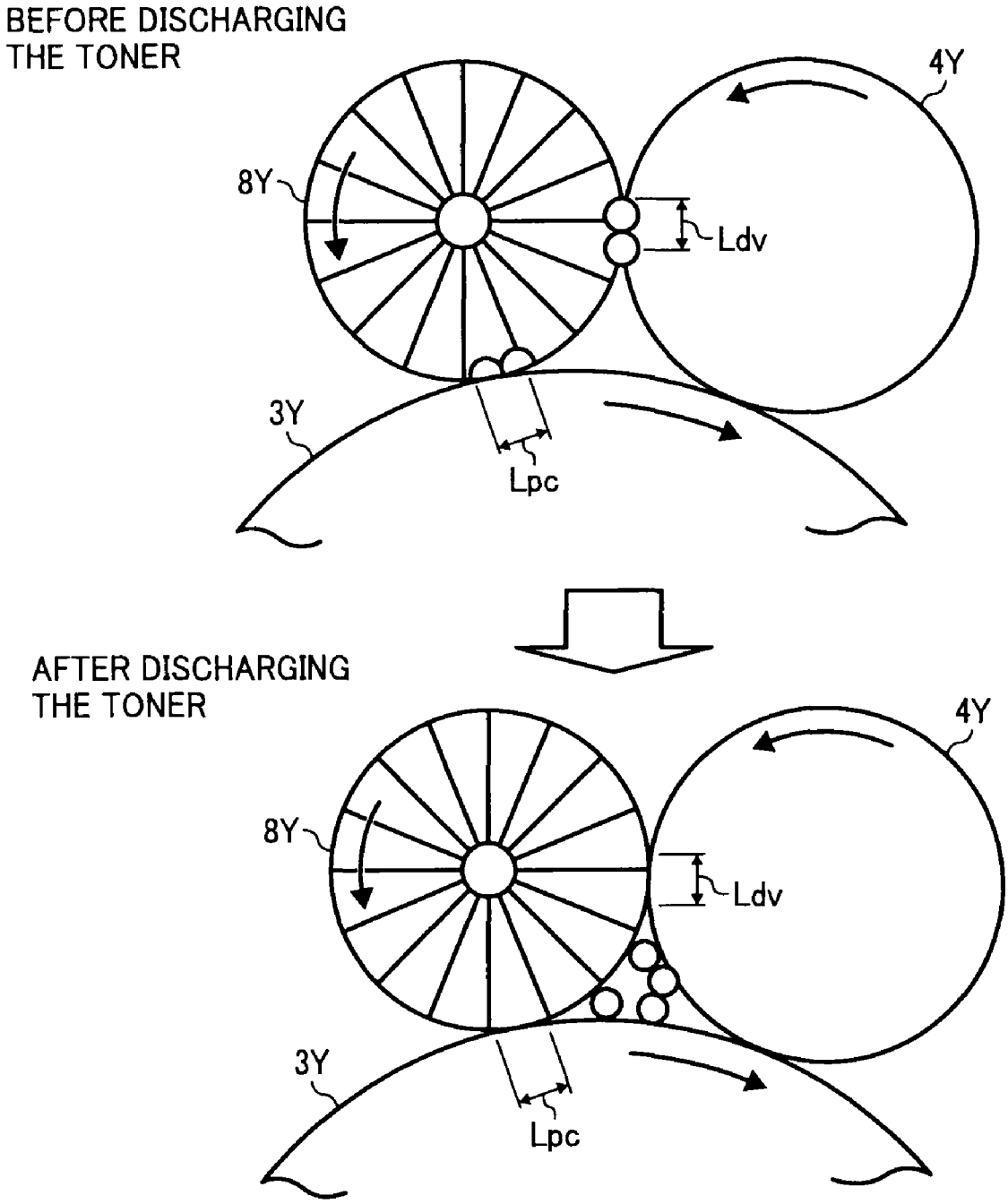
FIG. 4 is a diagram for explaining how the toner is discharged when the linear velocity ratio is smaller than 0.1.
Figure 5:
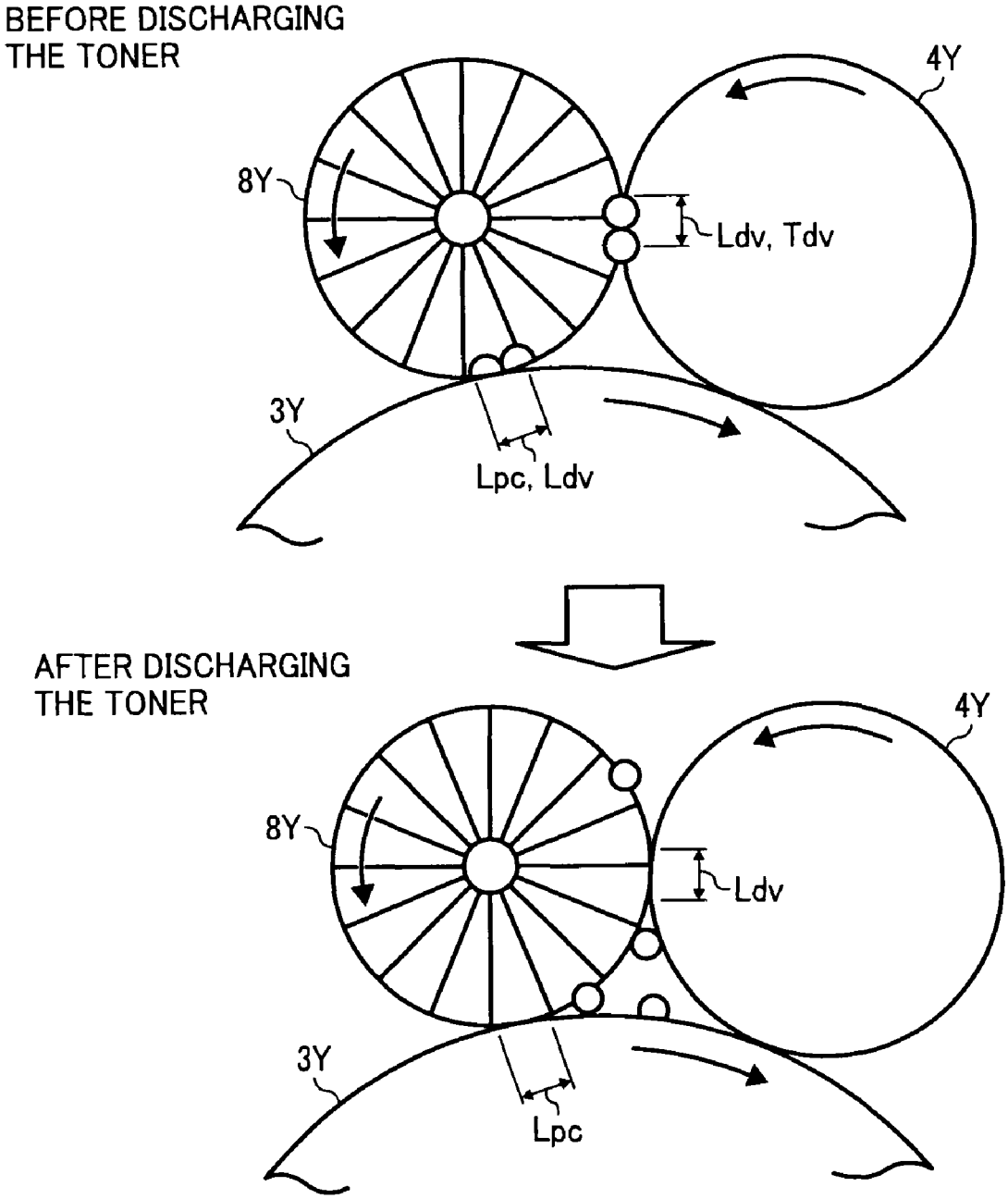
FIG. 5 is a diagram for explaining how the toner is discharged when the linear velocity ratio is larger than 0.9.

When discharging the transfer residual toner, the toners that are caught by the cleaning brush 8Y at voltage applicable areas (Lpc, Ldv) shown in FIG. 4 and FIG. 5 are discharged to the photoreceptor 3Y and the charging roller 4Y. Specifically, an outer peripheral portion of the cleaning brush 8Y is moved to the voltage applicable areas (Lpc, Ldv) sequentially as the cleaning brush 8Y rotates, and the toners in the moved outer peripheral portion of the cleaning brush 8Y are discharged to the photoreceptor 3Y and the charging roller 4Y. However, if the linear velocity ratio described above is smaller than 0.1, the cleaning brush 8Y rotates so slowly that the voltage applicable areas (Lpc, Ldv) seem to gather at substantially the same place. Therefore, if the linear velocity is smaller than 0.1, the entire toner discharging efficiency is lowered. Moreover, the relationship among the time at which the toners are discharged at a predetermined section on the cleaning brush 8Y (Tpc, Tdv), the voltage applicable areas (Lpc, Ldv), and the moving speed (linear velocity) of the cleaning brush is expressed by Equation 1 (Eq. 1). When the abovementioned linear velocity ratio is larger than 0.9, the moving speed (V) increases, and thus it is understood from Eq. (1) that the abovementioned toner discharging time (Tpc, Tdv) decreases. Therefore, when the abovementioned linear velocity ratio is larger than 0.9, the time period in which the toners are discharged from the cleaning brush 8Y at the voltage applicable areas to the photoreceptor 3Y and the charging roller 4Y becomes short, whereby the toner discharging efficiency is lowered.

$$Tpc=Lpc/V \text{ and } Tpc=Ldv/V \qquad \text{Eq. (1)}$$

Figures 6, 7:
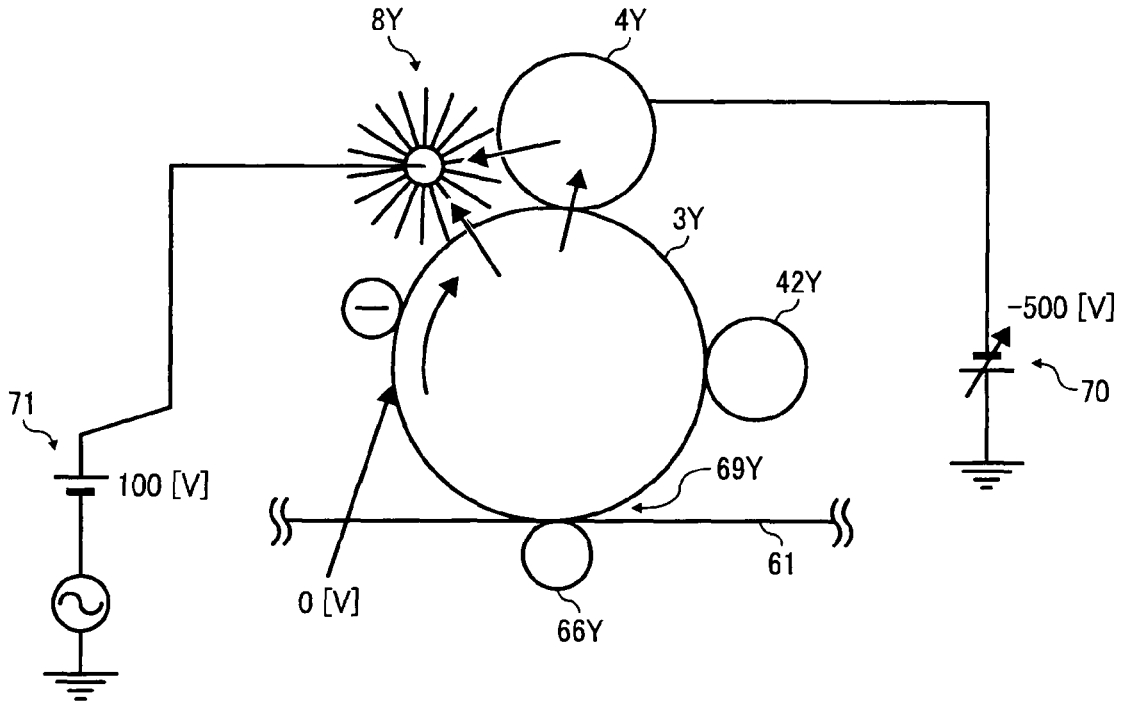
FIG. 6 is a table showing the relationship between the linear velocity ratio and the discharge rate.
FIG. 7 is a view showing a schematic configuration of a process unit when a print job of Example 1 is performed.

In order to maintain the cleaning performance of the cleaning brush 8Y over a long period of time, it is preferred that the toner discharge rate for discharging the toner from the cleaning brush 8Y be at least 15 [%]. FIG. 6 shows the relationship between the abovementioned linear velocity ratio and the toner discharge rate. Note that the linear velocity of the photoreceptor 3Y and the linear velocity of the charging roller at this moment are each 100 [mm/s].

It is clear from FIG. 6 that the toner discharge rate becomes 15 [%] or higher when the linear velocity ratio is 0.1 through 0.9. Therefore, according to this fact, by setting the linear velocity to 0.1 through 0.9 during the non-print job of the present example, the toners can be discharged efficiently from the cleaning brush 8Y.

Furthermore, the cleaning brush 8Y is cleaned by discharging the transfer residual toner caught by the cleaning brush 8Y to the photoreceptor 3Y, hence the cleaning performance of the cleaning brush 8Y can be maintained. Therefore, the photoreceptor 3Y and the charging roller 4Y can be cleaned well by the cleaning brush 8Y, whereby the photoreceptor 3Y can be charged well by the charging roller 4Y. Note that a cleaning roller may be used in place of the cleaning brush 8Y. In this case, it is preferred that the surface of the cleaning roller be made from an elastic body such as urethane foam. When recovering the transfer residual toner from the charging roller 4Y to the cleaning roller or the like by means of an electrostatic force and a frictional force, it is necessary to bring the cleaning roller and the charging roller 4Y into contact with each other until the surface of the cleaning roller is elastically deformed and collapsed, in order to obtain a large frictional force. Therefore, the above-described contact state can be achieved by using the cleaning roller, the surface of which is made from an elastic body such as urethane foam, and thus a large frictional force can be obtained at the contact portion between the charging roller 4Y and the cleaning roller. Moreover, because the urethane foam surface is indented, it can easily scrape the transfer residual toner off of the charging roller 4Y.

As described above, the present embodiment is configured to recover the transfer residual toner in the developing device 40Y, without providing a special cleaning device for recovering the transfer residual toner. By adopting the cleaner-less system of the present example, it is not necessary to provide a recovered-toner storage portion that is specially designed for recovering a transfer residual toner, and thus use of the system is effective in downsizing the apparatus main body. In addition, because the recovered toner can be reused for development, the toner can be effectively used, which is economical.

[Experiment 1]

The experiments performed by the three inventors of the present inventions will be described next.

The inventors of the present invention prepared a testing machine that has the same configuration as the printer of the present embodiment shown in FIG. 1 and FIG. 2. Using this testing machine, a monochrome half chart (half-tone image)

was printed continuously on one thousand A4 sheets at an image area ratio of 5 [%] under the conditions described below. Then, uneven charging of the photoreceptor 3Y was evaluated based on the printed images and the result of observation of an enlarged view of the photoreceptor 3Y. Specifically, the uneven charging was evaluated on a scale of three based on the level of the generation of white spots in the half chart: white spots exist (x), several white spots exist (Δ), and no white spot exists (○). In addition, when evaluating the uneven charging, the levels Δ and ○ were taken as acceptable levels, but the level x was taken as a level indicating that there is harm in use of the testing machine.

The diameter, the surface potential, and the linear velocity of the photoreceptor 3Y were 24 [mm], 0 [V], and 100 [mm/s] respectively.

As the charging roller 4Y, the one in a roller shape with a shaft diameter of 6.0 [mm] and an outer diameter of 10.0 [mm] was used. As the charging bias to be applied to the charging roller 4Y, a DC voltage of −500 [V] and a DC voltage of −800 [V] were applied at the time of a print job and at the time of a non-print job, respectively. A charging brush roller obtained by arranging a plurality of bristle fibers upright on a rotational axis member may be used as the charging member. The linear velocity thereof was set to 100 [mm/s].

As the biases to be applied to the cleaning brush 8Y, a bias obtained by superimposing AC voltage having a peak-to-peak voltage $V_{pp}$ of 1.0 [kV] and a frequency of 300 [Hz] at the time of a print job on +100 [V] DC voltages Vdc at the time of the print job, and a bias obtained by superimposing AC voltage having the same peak-to-peak voltage and a frequency of 10 [Hz] at the time of a non-print job on −1000 [V] DC voltage at the time of the non-print job were used. The duty ratio of the both biases was 45 [%]. Because the cleaning brush 8Y is a portion that first comes into contact with the transfer residual toner on the photoreceptor 3Y, at that moment a large quantity of transfer residual toner was adhered onto the photoreceptor 3Y. If the amount of transfer residual toner is high as described above, it is difficult to recover such transfer residual toner, and thus the toner is electrically vibrated by means of the fact that the direction of the polarity of the AC voltage changes, to release the toner from the photoreceptor 3Y easily. Accordingly, the toner recovery efficiency of the cleaning brush 8Y for recovering the toner from the photoreceptor 3Y improves. Moreover, when discharging toner caught by the cleaning brush 8Y to the photoreceptor 3Y and the charging roller 4Y, the toner caught by the cleaning brush 8Y is electrically vibrated using the AC voltage as described above, whereby the toner can be released easily from the cleaning brush 8Y, improving the discharging efficiency. Note that the frequency is preferably in the range of 5 [Hz] to 500 [Hz]. Normally, in the area of contact between the cleaning brush 8Y and the photoreceptor 3Y, the photoreceptor surface potential becomes the center value of the applied AC voltage due to the AC voltage applied to the cleaning brush 8Y, and thereby the movement of the toner from the cleaning brush 8Y to the photoreceptor 3Y and the movement of the toner from the photoreceptor 3Y to the cleaning brush 8Y enter a balanced state. When AC voltage with a low frequency is applied, the surface potential of the photoreceptor 3Y is induced to a lower waveform by the low frequency of the cleaning brush 8Y, and an average value can be secured as the difference between the AC voltage applied to the cleaning brush 8Y and the surface potential. Accordingly, the toner can be efficiently discharged from the cleaning brush 8Y to the photoreceptor 3Y. However, if the frequency is larger than 500 [Hz], the shape of the surface potential of the photoreceptor 3Y is not formed, and if the frequency is smaller than 5 [Hz], effectiveness of the AC voltage is lost, hence the toner cannot be discharged efficiently.

A roller-shaped member with a diameter of 11 [mm] in which a plurality of nylon bristle fibers having conductive particles are arranged upright on an unshown rotational axis member was used as the cleaning brush 8Y. Moreover, the biting amount of the cleaning brush against the photoreceptor 3Y was in the acceptable range of 0.1 to 1.0 [mm].

The experiment that was performed under the conditions described above was taken as Sample 1, and FIG. 7 shows a schematic configuration of the process unit 1Y at the time of the print job, while FIG. 3 shows a schematic configuration of the process unit 1Y at the time of the non-print job. In order to compare with Sample 1, experiments for Sample 2 through Sample 7 were performed under the conditions described below. Note that the conditions different from those of Sample 1 are the value of voltage applied to the charging roller 4Y, the value of voltage applied to the cleaning brush 8Y, and the states of contact between the cleaning brush 8Y and the photoreceptor 3Y and between the cleaning brush 8Y and the charging roller 4Y, and the rest of the conditions are the same as those of Sample 1, unless otherwise stated.

[Sample 2]

Voltage applied to the charging roller 4Y: −500 [V] at the time of a print job, −800 [V] at the time of a non-print job Voltage applied to the cleaning brush 8Y: 100 [V] at the time of the print job, −1000 [V] at the time of the non-print job The cleaning brush 8Y is in contact with the charging roller 4Y only

[Sample 3]

Voltage applied to the charging roller 4Y: −500 [V] at the time of a print job, −800 [V] at the time of a non-print job Voltage applied to the cleaning brush 8Y: 100 [V] at the time of the print job, −1000 [V] at the time of the non-print job The cleaning brush 8Y is in contact with the photoreceptor 3Y only

[Sample 4]

Voltage applied to the charging roller 4Y: −500 [V] at the time of a print job, −800 [V] at the time of a non-print job Voltage applied to the cleaning brush 8Y: 100 [V] at the time of the print job, −600 [V] at the time of the non-print job The cleaning brush 8Y is in contact with both the photoreceptor 3Y and the charging roller 4Y

[Sample 5]

Voltage applied to the charging roller 4Y: −500 [V] at the time of a print job, −800 [V] at the time of a non-print job Voltage applied to the cleaning brush 8Y: −200 [V] at the time of the print job, −1000 [V] at the time of the non-print job The cleaning brush 8Y is in contact with both the photoreceptor 3Y and the charging roller 4Y

[Sample 6]

Voltage applied to the charging roller 4Y: −600 [V] at the time of a print job, −800 [V] at the time of a non-print job Voltage applied to the cleaning brush 8Y: 200 [V] at the time of the print job, −1000 [V] at the time of the non-print job The cleaning brush 8Y is in contact with both the photoreceptor 3Y and the charging roller 4Y

[Sample 7]

Figure 9:
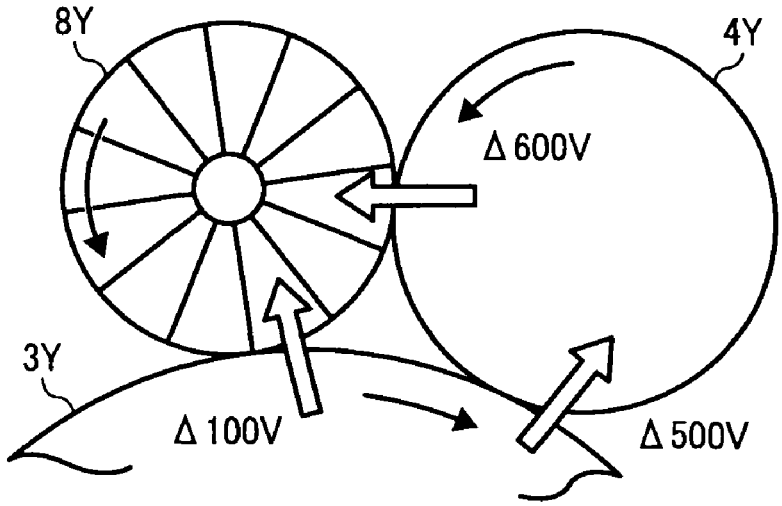
FIG. 9 is a view showing the optimum directions of movement of toners when the print job is performed.
Figure 10:
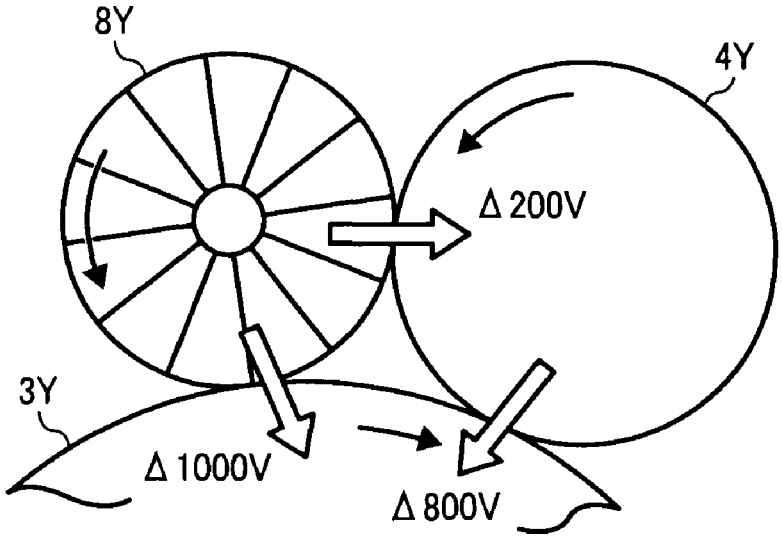
FIG. 10 is a view showing the optimum directions of movement of the toners when the non-print job is performed.

Voltage applied to the charging roller 4Y: −500 [V] at the time of a print job, −600 [V] at the time of a non-print job Voltage applied to the cleaning brush 8Y: 200 [V] at the time of the print job, −900 [V] at the time of the non-print job The cleaning brush 8Y is in contact with both the photoreceptor 3Y and the charging roller 4Y FIG. 8 shows the results of the experiments performed under the conditions described above. Note that the positive and negative values of the potentials shown in the potential gap at the time of recover and the potential gap at the time of discharge in the drawing are associated with the optimum directions of movement of the toners shown in FIGS. 9 and 10. If the value of the potential is positive, the direction of movement of the toner is the directions of the arrows shown in FIGS. 9 and 10, and if negative, the direction of movement of the toner is the direction opposite to each of the directions of the arrows. The priority of each potential gap is expressed as, using the reference numerals shown in the table, (C-A)→(B-A)→(C-B) at the time of recovery, and (A-B)→(A-C)→(B-C) at the time of discharge. Specifically, at the time of recovery, the transfer residual toner on the photoreceptor 3Y is removed, and thus the potential gap between the photoreceptor 3Y and the cleaning brush 8Y is in the first priority, and the potential gap between the photoreceptor 3Y and the charging roller 4Y is in the second priority because the transfer residual toner on the photoreceptor 3Y is removed by the charging roller 4Y later on. Moreover, at the time of discharge, the movement of the transfer residual toner between the photoreceptor 3Y and the charging roller 4Y affects a charging failure most, and thus the potential gap between the photoreceptor 3Y and the charging roller 4Y is in the first priority. Also, in the case of the movement of the transfer residual toner between the cleaning brush 8Y and the photoreceptor 3Y, the potential gap between the photoreceptor 3Y and the cleaning brush 8Y is in the second priority, as it is necessary to secure the cleaning performance without contaminating the charging roller 4Y.

Figure 11:
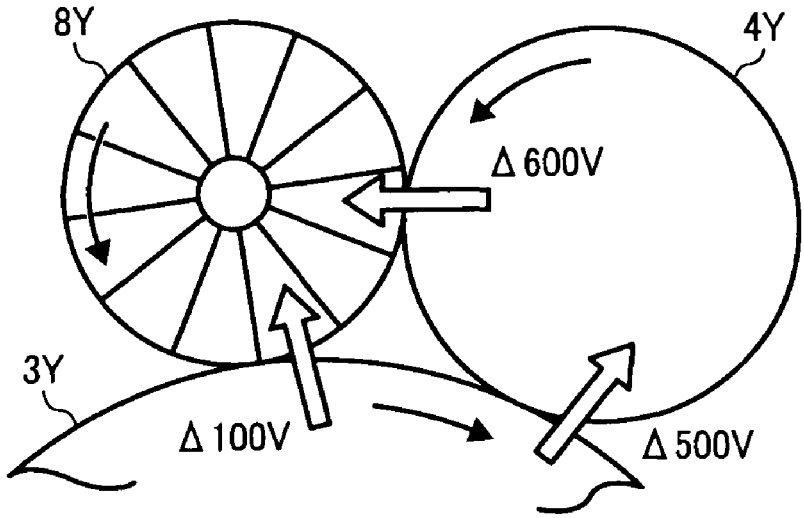
FIG. 11 is a view showing a situation of a potential gap between members when the print job of Example 1 is performed.
Figure 12:
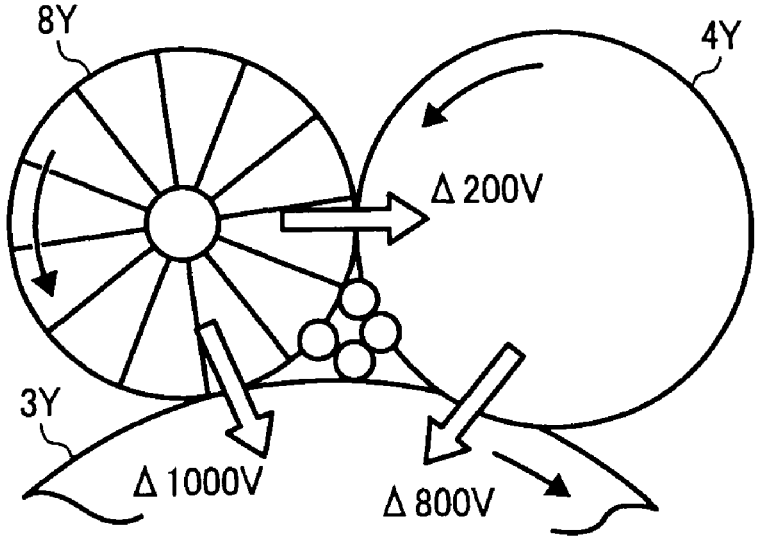
FIG. 12 is a view showing a situation of a potential gap between the members when the non-print job of Example 1 is performed.

It is understood from FIG. 8 that there is no white spot in Sample 1 and that the photoreceptor 3Y is charged well. FIG. 11 shows a state of the potential gap between the members when the print job is performed on Sample 1, while FIG. 12 shows a state of the potential gap between the members when the non-print job is performed.

In Sample 1, when the print job is performed, voltage for recovering the transfer residual toners adhered to both of the photoreceptor 3Y and the charging roller 4Y to the cleaning brush 8Y is applied. That is, a voltage of −500 [V] is applied to the charging roller 4Y, and a voltage of 100 [V] is applied to the cleaning brush 8Y. Accordingly, the transfer residual toners adhered to the photoreceptor 3Y having a surface potential of 0 [V] and the charging roller 4Y can be moved efficiently to the cleaning brush 8Y by means of the electrostatic force. Therefore, the photoreceptor 3Y and the charging roller 4Y become clean when the print job is about to be performed, and thus the charging roller 4Y can charge the photoreceptor 3Y well.

Also, when the non-print job is performed, voltage for discharging the transfer residual toners, which are recovered from the photoreceptor 3Y and the charging roller 4Y to the cleaning brush 8Y, to the photoreceptor 3Y directly or via the charging member is applied. That is, a voltage of −800 [V] is applied to the charging roller 4Y, and a voltage of −1000 [V] is applied to the cleaning brush 8Y. Accordingly, the transfer residual toners accumulated on the cleaning brush 8Y are moved efficiently to the photoreceptor 3Y having a surface potential of 0 [V] by the electrostatic force directly or via the charging roller 4Y. Note that in the present example, because the cleaning brush 8Y rotates in the counter direction to the direction of rotation of the charging roller 4Y, the transfer residual toners can be moved more efficiently from the cleaning brush 8Y to the charging roller 4Y by the frictional force generated between the charging roller 4Y and the cleaning brush 8Y. Accordingly, the cleaning brush 8Y is cleaned, whereby the cleaning performance thereof is maintained. Therefore, the photoreceptor 3Y and the charging roller 4Y are cleaned well by the cleaning brush 8Y over a long period of time, and the transfer residual toners discharged onto the photoreceptor 3Y are recovered by the developing device 40Y. For this reason, it is considered that the photoreceptor 3Y can be charged well by the charging roller 4Y even when making one thousand prints.

Figure 13:
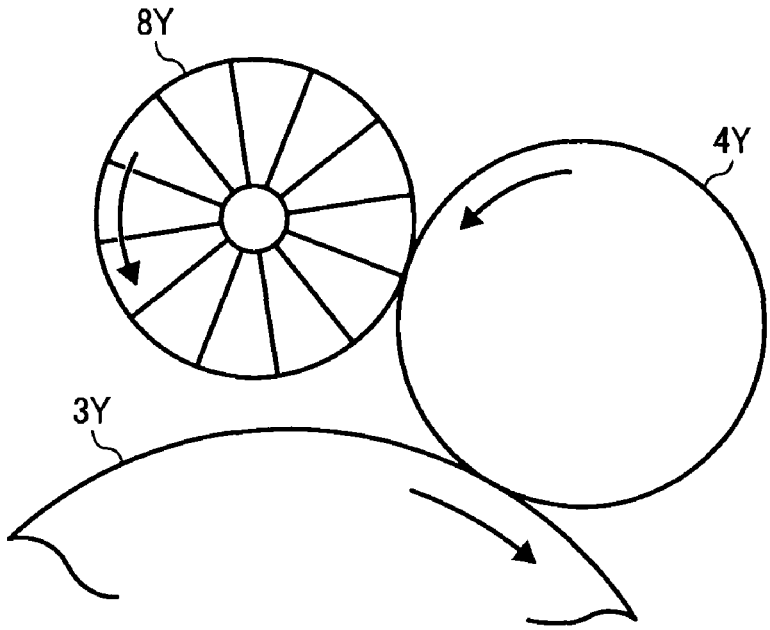
FIG. 13 is a view showing a positional relationship among a photoreceptor, a charging roller and a cleaning brush in Sample 2.

FIG. 13 shows a positional relationship among the photoreceptor 3Y, the charging roller 4Y and the cleaning brush 8Y in Sample 2. Sample 2 is obtained when the cleaning brush 8Y is brought into contact with the charging roller 4Y only. In this case, since the photoreceptor 3Y is not cleaned by the cleaning brush 8Y, the residual toner on the photoreceptor 3Y needs to be removed by the charging roller 4Y only. However, when the toner is recovered from the photoreceptor 3Y to the charging roller 4Y, that is, when the print job is performed, the relationship between the potential of the photoreceptor 3Y and the potential of the charging roller 4Y is expressed as "potential of the photoreceptor 3Y (0 [V])>potential of the charging roller 4Y (−500 [V])", and thus the toner is not transferred from the photoreceptor 3Y to the charging roller 4Y by the electrostatic force. Therefore, the charging roller 4Y removes the toner from the photoreceptor 3Y by means of the frictional force between the charging roller 4Y and the photoreceptor 3Y, hence the charging roller 4Y cannot remove the toner sufficiently from the photoreceptor 3Y when the print job is performed. Note that although the transfer residual toner that is not recovered by the charging roller 4Y is recovered by the developing device 40, the transfer residual toner that is not recovered by the developing device 40 remains on the photoreceptor 3Y in consideration of the charged state of the transfer residual toner (the opposite polarity and the low charged amount). For this reason, the photoreceptor 3Y cannot be cleaned in a long run, compared to when bringing the cleaning brush 8Y into contact with the photoreceptor 3Y to recover the transfer residual toner on the photoreceptor 3Y by means of the electrostatic force or frictional force. Therefore, compared to when bringing the cleaning brush 8Y into contact with both the photoreceptor 3Y and the charging roller 4Y, a charging failure of the photoreceptor 3Y occurs, and thereby it is considered that a few white spots are generated.

Figure 14:
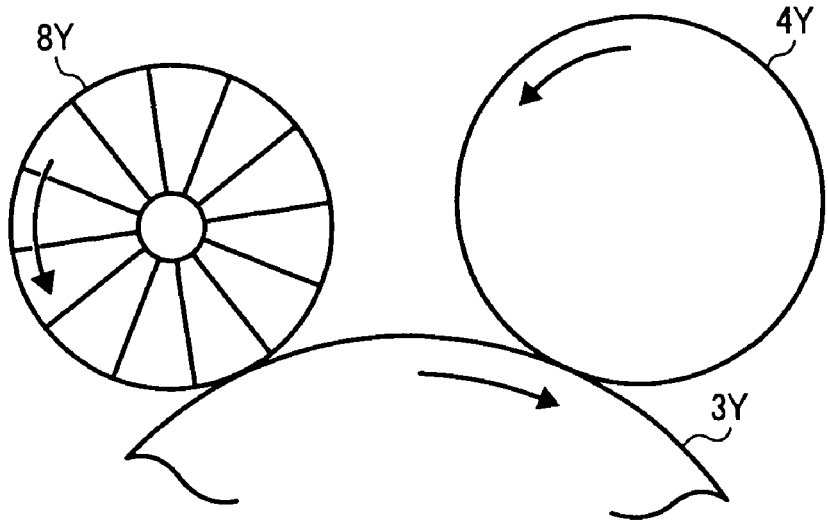
FIG. 14 is a view showing a positional relationship among a photoreceptor, a charging roller and a cleaning brush in Sample 3.

FIG. 14 shows a positional relationship among the photoreceptor 3Y, the charging roller 4Y and the cleaning brush 8Y in Sample 3. Sample 3 is obtained when the cleaning brush 8Y is brought into contact with the photoreceptor 3Y only. In this case, since the charging roller 4Y is not cleaned by the cleaning brush 8Y, it is considered that a charging failure of the photoreceptor 3Y occurs due to the influence of transfer residual toner adhered to the charging roller 4Y.

In Sample 4, the potential of the cleaning brush 8Y is −600 [V] when the non-print job is performed, and the magnitude relationship between the potential of the charging roller 4Y and the potential of the cleaning brush 8Y at the time of the non-print job is opposite to that of Sample 1. Specifically, the magnitude relationship is such that "potential of the charging roller 4Y >potential of the cleaning brush 8Y" in Sample 1, but it is "potential of the charging roller 4Y<potential of the cleaning brush 8Y" in Sample 4. Accordingly, when the non-print job is performed, the toner accumulated on the cleaning brush 8Y is not discharged to the charging roller 4Y by means of the electrostatic force. Moreover, because the difference between the potential of the photoreceptor 3Y and the potential of the cleaning brush 8Y at the time of the non-print job is smaller than that obtained in Sample 1 by 400 [V], the amount of toner discharged from the cleaning brush 8Y to the photoreceptor 3Y is smaller than that of Sample 1. Therefore, the toner accumulated on the cleaning brush 8Y cannot be discharged efficiently when the non-print job is performed, whereby the toner accumulates on the cleaning brush 8Y in the long run. Therefore, the cleaning performance of the cleaning brush 8Y is lowered, and thereby the photoreceptor 3Y and the charging roller 4Y cannot be cleaned well. Therefore, it is considered that a charging failure of the photoreceptor 3Y occurs.

In Sample 5, the potential of the cleaning brush 8Y is −200 [V] when the print job is performed. The magnitude relationship between the potential of the photoreceptor 3Y and the potential of the cleaning brush 8Y at the time of the print job is opposite to that obtained in Sample 1, and the difference between the potential of the charging roller 4Y and the potential of the cleaning brush 8Y at the time of the print job is different from that of Sample 1. Specifically, the magnitude relationship is such that "potential of the cleaning brush 8Y >potential of the photoreceptor 3Y" in Sample 1, but it is "potential of the cleaning brush 8Y<potential of the photoreceptor 3Y" in Sample 5. Moreover, the difference between the potential of the charging roller 4Y and the potential of the cleaning brush 8Y is 600 [V] in Sample 1, while the difference between the potential of the charging roller 4Y and the potential of the cleaning brush 8Y is 300 [V] in Sample 5. Therefore, the toner is not transferred from the photoreceptor 3Y to the cleaning brush 8Y by means of the electrostatic force in Sample 5, and the electrostatic force generated between the charging roller 4Y and the cleaning brush in Sample 5 is smaller than that of Sample 1, hence the amount of toner transferred from the charging roller 4Y to the cleaning brush 8Y is smaller than that of Sample 1. For this reason, the photoreceptor 3Y and the charging roller 4Y are not cleaned well when the print job is performed, and thus it is considered that a charging failure of the photoreceptor 3Y occurs.

In Sample 6, the potential of the charging roller 4Y and the potential of the cleaning brush 8Y at the time of the print job are −600 [V] and 200 [V] respectively, and the difference between the potential of the charging roller 4Y and the potential of the cleaning brush 8Y at the time of the print job and the difference between the potential of the photoreceptor 3Y and the potential of the cleaning brush 8Y are larger, compared to Sample 1. If the magnitude relationship between the potential of the charging roller 4Y and the potential of the cleaning brush 8Y, and if the magnitude relationship between the potential of the photoreceptor 3Y and the potential of the cleaning brush 8Y in Sample 6 are equal to those of Sample 1, the difference between the potential of the charging roller 4Y and the potential of the cleaning brush 8Y and the difference between the potential of the photoreceptor 3Y and the potential of the cleaning brush 8Y become larger, compared to Sample 1, hence the toners can be transferred from the photoreceptor 3Y and the charging roller 4Y to the cleaning brush 8Y easily by the electrostatic force. Therefore, the photoreceptor 3Y and the charging roller 4Y are cleaned well at the time of the print job. Furthermore, because the toner accumulated on the cleaning brush 8Y is removed well in the same manner as in Sample 1 when the non-print job is performed, the cleaning performance of the cleaning brush 8Y is maintained over a long period of time, and thus the photoreceptor 3Y can be charged well over a long period of time.

In Sample 7, the potential of the cleaning brush 8Y is 200 [V] when the print job is performed, the potential of the charging roller 4Y is −600 [V] when the non-print job is performed, and the potential of the cleaning brush 8Y is −900 [V] when the non-print job is performed. The difference between the potential of the charging roller 4Y and the potential of the cleaning brush 8Y and the difference between the potential of the photoreceptor 3Y and the potential of the cleaning brush 8Y at the time of the print job are larger, compared to Sample 1, and the difference between the potential of the charging roller 4Y and the potential of the cleaning brush 8Y at the time of the non-print job is larger, compared to Sample 1. As with Sample 6, if, in Sample 7, the magnitude relationship between the potential of the charging roller 4Y and the potential of the cleaning brush 8Y and the magnitude relationship between the potential of the photoreceptor 3Y and the potential of the cleaning brush 8Y are equal to those of Sample 1, the difference between the potential of the charging roller 4Y and the potential of the cleaning brush 8Y and the difference between the potential of the photoreceptor 3Y and the potential of the cleaning brush 8Y at the time of the print job become larger, compared to Sample 1, hence the toner can be transferred from the photoreceptor 3Y and from the charging roller 4Y to the cleaning brush 8Y easily by means of the electrostatic force. Moreover, the magnitude relationship between the above potentials becomes equal to that of Sample 1, and the difference between the potential of the charging roller 4Y and the potential of the cleaning brush 8Y at the time of the non-print job becomes larger, compared to Sample 1, hence the toner accumulated on the cleaning brush 8Y is transferred from the cleaning brush 8Y to the charging roller 4Y easily by means of the electrostatic force, and thereby the toner can be removed efficiently from the cleaning brush 8Y. As a result, the cleaning performance of the cleaning brush 8Y can be maintained over a long period of time, and the photoreceptor 3Y can be charged well over a long period of time.

Example 2

The printer according to Example 2 will be described next. Note that the configuration of the printer according to Example 2 is the same as that of the above embodiment, unless otherwise stated.

Figure 15:
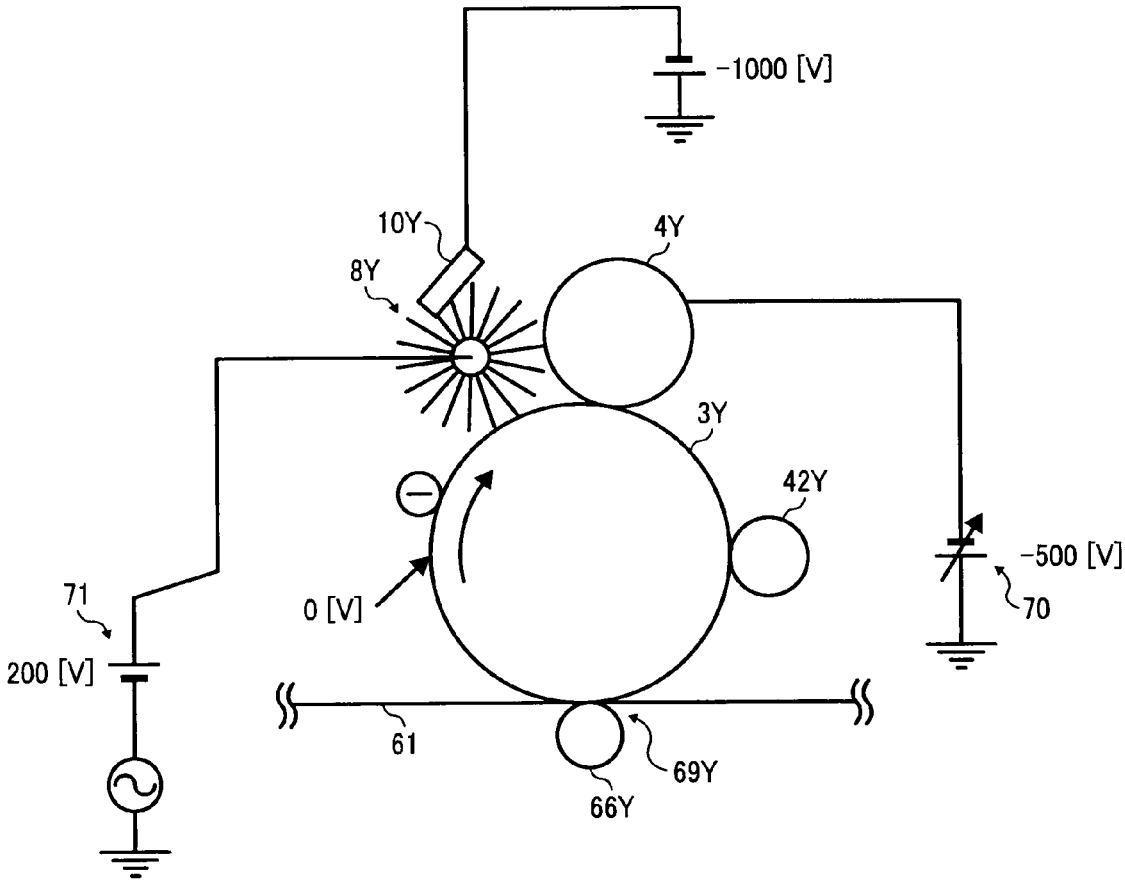
FIG. 15 is a view showing a schematic configuration of the process unit when the print job of Example 2 according to the present embodiment is performed.

FIG. 15 is an enlarged configuration diagram showing the Y process unit 1Y of the printer according to Example 2. The other process units 1M, 1C and 1K of the respective colors have the same configuration as the Y process unit.

Example 2 adopts the temporary catching type cleaner-less system, as with Example 1. Although the basic configuration of the apparatus main body is the same in Example 2 and Example 1, Example 2 has, in addition to the configuration of Example 1, a configuration in which a conductive sheet 10Y made of a cantilevered conductive sheet is provided in the apparatus main body such that a free end side of the conductive sheet is made abut against the cleaning brush 8Y. The conductive sheet 10Y with such a configuration is supplied with a pre-charging bias consisting of DC voltage by pre-charging bias supply means configured by a power supply and wires provided in the apparatus main body. Examples of the matrix resin of the conductive sheet 10Y include polyvinylidene fluoroethylene (PVDF), nylon, polytetrafluoroethylene (PTFE), urethane, polyethylene, a combination of two or more of these, and the like. In Example 2, a pre-charging bias with the negative polarity is applied to the conductive sheet 10Y, and thereby the transfer residual toner caught by the cleaning brush 8Y is charged uniformly to a negative polarity, which is the regular polarity, at the same charge amount. When the transfer residual toner is discharged from the cleaning brush 8Y to the photoreceptor 3Y and the charging roller 4Y by means of the electrostatic force, the transfer residual toner can be discharged more efficiently if the charge amount of the transfer residual toner is at a certain level or higher. Therefore, by charging the transfer residual toner to the opposite polarity by means of primary transfer, or by uniformly charging the transfer residual toner having a reduced charge amount to the regular polarity at the same charge amount by means of the conductive sheet 10Y, the transfer residual toner can be discharged from the cleaning brush 8Y to the photoreceptor 3Y and the charging roller 4Y more efficiently than when the conductive sheet 10Y is made abut against the cleaning brush 8Y.

Upon completion of the print job or in inter-sheet timing, which is a time period of in which an electrostatic latent image is not formed by the writing means, the transfer residual toner caught by the cleaning brush 8Y is re-transferred from the cleaning brush to the photoreceptor 3Y directly and via the charging roller 4Y by switching the voltage of a charging bias to be applied to the cleaning brush 8Y from superimposed voltage to DC voltage. Note in Example 2 that the transfer residual toner caught by the cleaning brush 8Y is charged uniformly to the negative polarity, i.e., the regular polarity, by the conductive sheet 10Y, and thus the transfer residual toner is discharged efficiently from the cleaning brush 8Y to the photoreceptor 3Y and the charging roller 4Y by the electrostatic force when re-transferring the transfer residual toner. The transfer residual toner that is re-transferred to the photoreceptor 3Y in this manner is recovered from the photoreceptor 3Y into the developing device 40Y via the developing roller 42Y.

[Experiment 2]

The inventors of the present invention prepared a testing machine that has the same configuration as the printer of the embodiments shown in FIG. 1 and FIG. 15. Using this testing machine, a monochrome half chart (half-tone image) was printed on an A4 sheet at an image area ratio of 5 [%] under the conditions described below. Then, as with Experiment 1, uneven charging of the photoreceptor 3Y was evaluated based on the printed image and the result of observation of an enlarged view of the photoreceptor 3Y.

Experiment 2 was performed under a condition in which the conductive sheet 10Y is or is not made abut against the cleaning brush 8Y, in addition to the conditions provided in Sample 7 for Experiment 1 in which a good charged state was obtained when making one thousand prints. Specifically, as is clear from Experiment 1, the condition in which the conductive sheet is not made abut against the cleaning brush was taken as Sample 7, and the condition in which the conductive sheet is made abut against the cleaning brush was taken as Sample 8. The other conditions were the same as those of Experiment 1, unless otherwise stated. Note that a voltage of −1000 [V] was applied to the conductive sheet 10Y, and that the charged state of the photoreceptor 3Y was evaluated when one thousand prints were made and when two thousand prints were made.

FIG. 16 shows the results of the experiment performed under the above conditions.

As is understood from FIG. 16, when one thousand prints were made, the charged state of the photoreceptor 3Y was good regardless of whether the conductive sheet 10Y was made abut against the cleaning brush 8Y in both Sample 7 and Sample 8. However, when two thousand prints were made, the charged state of the photoreceptor 3Y was so poor that white spots were generated in Sample 7, i.e., under the condition in which the conductive sheet 10Y was not made abut against the cleaning brush 8Y. In sample 8, i.e., under the condition in which the conductive sheet 10Y was made abut against the cleaning brush 8Y, the charged state of the photoreceptor 3Y was good and no white spot was generated.

The transfer residual toner, which contains a toner that is charged to a polarity opposite to the regular polarity, and a toner with a low charge amount that is charged slightly to the regular polarity, is caught by the cleaning brush 8Y. Even when trying to discharge such transfer residual toner from the cleaning brush 8Y to the photoreceptor 3Y and the charging roller 4Y, the oppositely charged toner and the toner with a low charge amount cannot be discharged efficiently, hence these toners gradually accumulate on the cleaning brush 8Y. For this reason, the amount of toner accumulating on the cleaning brush 8Y increases as the number of prints increases, whereby the cleaning performance of the cleaning brush 8Y is lowered, and the photoreceptor 3Y and the charging roller 4Y cannot be cleaned well, causing a charging failure. Therefore, in Sample 7, although a good charged state was obtained when making one thousand prints, a charging failure has occurred when making two thousand prints for the reasons described above.

Unlike Sample 7, in Sample 8 the conductive sheet 10Y applied with −1000 [V] bias is made abut against the cleaning brush 8Y, hence the transfer residual toner caught by the cleaning brush 8Y is charged uniformly to the negative polarity, i.e., the regular polarity, at the same charge amount, regardless of the regular polarity, opposite polarity and low charge amount. Accordingly, the transfer residual toner caught by the cleaning brush 8Y is discharged efficiently from the cleaning brush 8Y to the photoreceptor 3Y and the charging roller 4Y by the electrostatic force, and thus the cleaning performance of the cleaning brush 8Y can be maintained over a long period of time. Therefore, the photoreceptor 3Y and the charging roller 4Y can be cleaned well by the cleaning brush 8Y for a long time. By making the conductive sheet 10Y abut against the cleaning brush 8Y as in Sample 8, it is considered that a good charged state can be obtained when making two thousand prints.

Example 3

The printer according to Example 3 will be described next. Note that the configuration of the printer according to Example 3 is the same as the above embodiment, unless otherwise stated.

Figure 17:
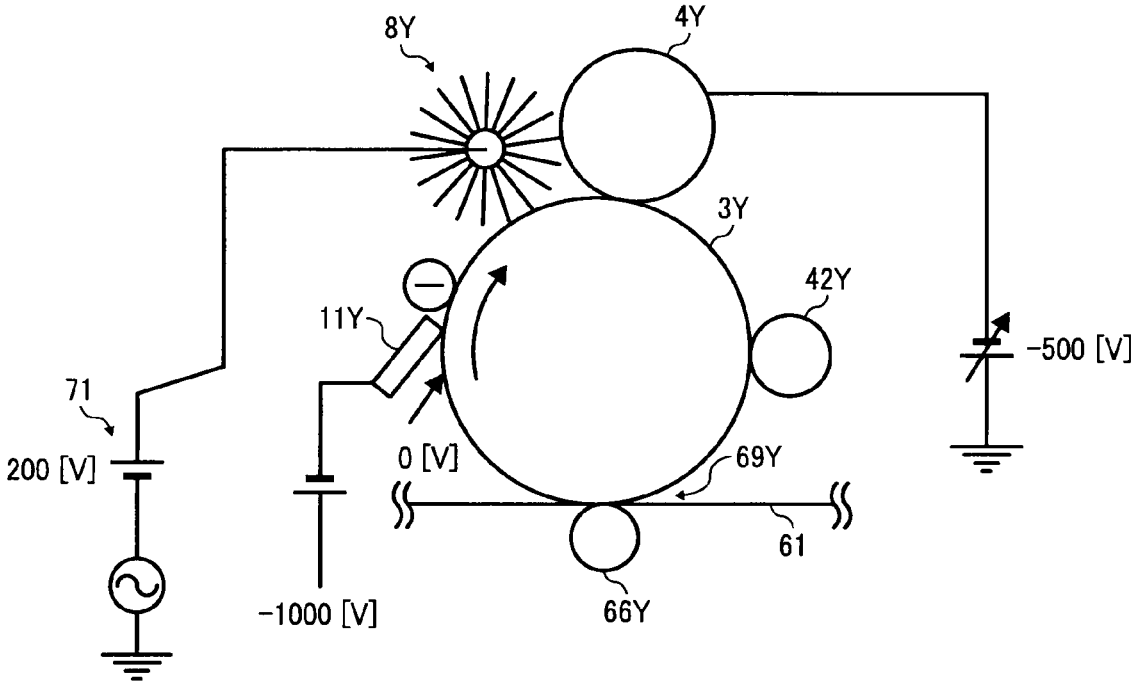
FIG. 17 is a view showing a schematic configuration of the process unit when the print job of Example 3 is performed.

FIG. 17 is an enlarged configuration diagram showing the Y process unit 1Y of the printer according to Example 3. The other process units 1M, 1C and 1K of the respective colors have the same configuration as the Y process unit.

Example 3 adopts the temporary catching type cleaner-less system, as with Example 1 and Example 2. Although the basic configuration of the apparatus main body of Example 3 is the same as that of Example 1 and of Example 2, in Example 3 the conductive sheet, which is made abut against the cleaning brush in Example 2, is made abut against the surface of the photoreceptor 3Y instead of the cleaning brush 8Y, the photoreceptor 3Y being located in the upstream side in the photoreceptor rotational direction in relation to the cleaning brush 8Y. Note that the characteristics of a conductive sheet 11Y used in Example 3 and a bias applied thereto by the pre-charging bias supply means are the same as those of Example 2. Using this conductive sheet 11Y, the polarity of the transfer residual toner that is charged to the positive polarity opposite to the polarity of the photoreceptor 3Y can be charged to the negative polarity, which is the regular polarity.

Therefore, by uniformly charging the transfer residual toner on the photoreceptor 3Y to the negative polarity, which is the regular polarity, the transfer residual toner can be caught easily by the cleaning brush 8Y applied with a bias having the positive polarity, and then the transfer residual toner is transferred to the cleaning brush 8Y and temporarily caught by the cleaning brush, as shown in the diagram.

Upon completion of the print job or in inter-sheet timing, the transfer residual toner caught by the cleaning brush 8Y is re-transferred from the cleaning brush to the photoreceptor 3Y directly and via the charging roller 4Y by switching the voltage of a charging bias to be applied to the cleaning brush 8Y from superimposed voltage to DC voltage. Thereafter, the transfer residual toner is recovered from the photoreceptor 3Y into the developing device 40Y via the developing roller 42Y. Note that the transfer residual toner caught by the cleaning brush 8Y is charged uniformly to the negative polarity, i.e., the regular polarity, at the same charge amount by the conductive sheet 11Y prior to being caught by the cleaning brush 8Y, and thus the transfer residual toner can be discharged efficiently from the cleaning brush 8Y to the photoreceptor 3Y and the charging roller 4Y when re-transferring the transfer residual toner, as described in Example 2.

[Experiment 3]

The inventors of the present invention prepared a testing machine that has the same configuration as the printer of the embodiments shown in FIG. 3 and FIG. 17. Using this testing machine, a monochrome half chart (half-tone image) was printed on an A4 sheet at an image area ratio of 5 [%] under the conditions described below. Then, as with Experiment 1 and Experiment 2, uneven charging of the photoreceptor 3Y was evaluated based on the printed image and the result of observation of an enlarged view of the photoreceptor 3Y.

Experiment 3 was performed under a condition in which the conductive sheet 11Y is or is not made abut against the surface of the photoreceptor 3Y located on the upstream side in the photoreceptor rotational direction in relation to the cleaning brush 8Y, in addition to the conditions provided in Sample 7 for Experiment 1 in which a good charged state was obtained when making one thousand prints. Specifically, as is clear from the configuration of the apparatus main body of Experiment 1, the condition in which the conductive sheet is not made abut against the cleaning brush was taken as Sample 7, and the condition in which the conductive sheet is made abut against the cleaning brush was taken as Sample 9 that shows the distinctive configurations of Example 3. The other conditions were the same as those of Experiment 1, unless otherwise stated. Note that a bias of −1000 [V] was applied to the conductive sheet 11Y, and that the charged state of the photoreceptor 3Y was evaluated when one thousand prints were made and when two thousand prints were made.

FIG. 18 shows the results of the experiment performed under the above conditions.

As is understood from FIG. 18, when one thousand prints were made, the charged state of the photoreceptor 3Y was good regardless of whether the conductive sheet 11Y was made abut against the surface of the photoreceptor 3Y in both Sample 7 and Sample 9.

When two thousand prints were made, the charged state of the photoreceptor 3Y was so poor that white spots were generated in Sample 7, i.e., under the condition in which the conductive sheet 11Y was not made abut against the surface of the photoreceptor 3Y, for the reasons described in Experiment 2. In sample 9, i.e., under the condition in which the conductive sheet 11Y was made abut against the surface of the photoreceptor 3Y, the charged state of the photoreceptor 3Y was good and no white spot was generated.

When considering the results of experiment on Sample 9, the conductive sheet 11Y applied with −1000 [V] bias is made abut against the surface of the photoreceptor 3Y, hence the transfer residual toner on the surface of the photoreceptor 3Y is charged uniformly to the negative polarity, i.e., the regular polarity, at the same charge amount, regardless of the regular polarity, opposite polarity and low charge amount. Accordingly, because the bias with the positive polarity is applied to the cleaning brush 8Y in Example 3, the transfer residual toner on the surface of the photoreceptor 3Y is caught efficiently by the cleaning brush 8Y using the electrostatic force. Consequently, the surface of the photoreceptor 3Y becomes cleaner compared to the configuration of Example 1, hence the photoreceptor 3Y is charged well by the charging roller 4Y. Moreover, because the transfer residual toner caught by the cleaning brush 8Y is charged uniformly to the negative polarity, i.e., the regular polarity, by the conductive sheet 11Y prior to being caught by the cleaning brush 8Y, the transfer residual toner can be discharged efficiently from the cleaning brush 8Y to the photoreceptor 3Y and the charging roller 4Y by means of the electrostatic force, and thereby the cleaning performance of the cleaning brush 8Y can be maintained over a long period of time. Therefore, the photoreceptor 3Y and the charging roller 4Y can be cleaned well by the cleaning brush 8Y over a long period of time. By making the conductive sheet 11Y abut against the surface of the photoreceptor 3Y as in Sample 9, it is considered that a good charged state can be obtained when making two thousand prints.

As described above, according to the present embodiment, the printer, which is the image forming apparatus, has: the photoreceptor 3 serving as the latent image carrier for carrying a latent image on the endlessly moving surface thereof; the developing device 40 serving as the developing means for developing the latent image on the photoreceptor 3 by means of a toner; the charging roller 4 serving as the charging member that uniformly charges the surface of the photoreceptor 3 while endlessly moving the surface of the charging member in contact with the photoreceptor 3; the power supply device 70 serving as the first bias supply means for supplying a bias to the charging roller 4; the cleaning brush 8 serving as the cleaning member that recovers at least toners adhered to the surfaces of the photoreceptor 3 and the charging roller 4, while endlessly moving the surface of the cleaning member in contact with the photoreceptor 3 and the charging roller 4 on the upstream side in the photoreceptor rotational direction in relation to the charging roller 4, to clean the surfaces of the photoreceptor 3 and the charging roller 4; and the power supply device 71 serving as the second bias supply means for supplying a bias to the cleaning brush 8. In this printer, at least one of the followings is performed: supplying a bias from the power supply device 71 to the cleaning brush 8 to transfer the toners from the cleaning brush 8 to a non-image area on the surface of the photoreceptor 3 such as to transfer the toners directly from the cleaning brush 8 to the non-image area by means of an electrostatic force, the toners being recovered from the photoreceptor 3 and the charging roller 4 to the cleaning brush 8; and supplying a bias from the power supply device 70 to the charging roller 4, and supplying a bias from the power supply device 71 to the cleaning brush 8, to transfer the recovered toners from the cleaning brush 8 to the non-image area such as to transfer the toners from the cleaning brush 8 to the non-image area via the charging roller 4. Consequently, the toners transferred onto the non-image area, that is, the photoreceptor 3, are recovered by the developing device 40. Accordingly, the transfer residual toner accumulated on the cleaning brush 8 is transferred onto the photoreceptor 3 by the electrostatic force, hence the cleaning brush 8 becomes clean, and thereby the cleaning performance of the cleaning brush 8 improves. Therefore, the photoreceptor 3 and the charging roller 4 can be cleaned well by the cleaning brush 8 over a long period of time, and the photoreceptor 3 can be charged well by the charging roller 4 over a long period of time. Moreover, because the transfer residual toners that are transferred from the cleaning brush 8 onto the photoreceptor 3 are recovered by the developing device 40, it is not necessary to provide a toner recovery portion that is specially designed for recovering the transfer residual toners, hence the apparatus main body can be downsized.

In addition, according to the present embodiment, when a print job is performed, that is, when image formation is performed, the power supply device 70 applies to the charging roller 4 a bias for transferring the toners adhered to both surfaces of the photoreceptor 3 and the charging roller 4 to the cleaning brush 8 by means of the electrostatic force, and the power supply device 71 supplies such bias to the cleaning brush 8. Accordingly, the transfer residual toners adhered to the photoreceptor 3 and the charging roller 4 can be transferred efficiently to the cleaning brush 8 by means of the electrostatic force. Therefore, the photoreceptor 3 and the charging roller 4 are cleaned at the time of the print job, and thus the photoreceptor 3 can be charged well by the charging roller 4.

According to the present embodiment, the toners are charged to a negative polarity. When the print job is performed, the power supply device 70 supplies a bias to the charging roller 4, while the power supply device 71 supplies a bias to the cleaning brush 8, so that the potential of the cleaning brush 8 becomes higher than the potentials of the charging roller 4 and photoreceptor 3. When the non-print job is performed, the power supply device 70 applies a bias to the charging roller 4, while the power supply device 71 applies a bias to the cleaning brush 8, so that the potential of the cleaning brush 8 becomes lower than the potentials of the charging roller 4 and photoreceptor 3, and so that the potential of the charging roller 4 becomes lower than the potential of the photoreceptor 3. Accordingly, when the print job is performed, the abovementioned toners are transferred from the photoreceptor 3 and the charging roller 4 toward the cleaning brush 8 by the electrostatic force, while when the non-print job is performed the toners are transferred from the cleaning brush 8 toward the photoreceptor 3 via the photoreceptor 3 and the charging roller 4 by the electrostatic force. Therefore, the toners that are charged to the negative polarity are securely transferred to a predetermined member, that is, the cleaning brush 8 without causing them to adhere to the photoreceptor 3 and the charging roller 4 again when the print job is performed, and are also transferred to the photoreceptor 3 without causing them to adhere to the cleaning brush 8 again when the non-print job is performed.

According to the present embodiment, the power supply device 71 applies a bias obtained by superimposing AC voltage on DC voltage to the cleaning brush 8. Accordingly, the toner adhered to the photoreceptor 3 or the toner caught by the cleaning brush 8 can be electrically vibrated by means of the characteristics of the AC voltage. Therefore, the toner can be released from each member easily, hence the toner recovery efficiency of the cleaning brush 8 for recovering the toner from the photoreceptor 3 and the toner discharging efficiency of discharging the toner from the cleaning brush 8 onto the photoreceptor 3 can be improved more, compared to when only the DC voltage is applied to the cleaning brush 8.

According to the present embodiment, the frequency of the AC voltage is in the range of 5 Hz to 500 Hz. If the frequency is smaller than 5 [Hz], effectiveness of the AC voltage is lost, and if the frequency is larger than 500 [Hz], the shape of the surface potential of the photoreceptor 3 is not formed, and thus the toner cannot be discharged efficiently. Therefore, by setting the frequency to 5 Hz to 500 Hz as in the present embodiment, the toner can be discharged efficiently from the cleaning brush 8 onto the photoreceptor 3.

According to the present embodiment, at least when the non-print job is performed, the rotational directions of the charging roller 4 and the cleaning roller 8 follow the rotational direction of the photoreceptor 3. Accordingly the transfer residual toner caught by the cleaning brush 8 can be transferred efficiently to the charging roller 4 by the frictional force generated between the cleaning brush 8 and the charging roller 4, and thus eventually the transfer residual toner caught by the cleaning brush 8 can be discharged efficiently onto the photoreceptor 3.

According to the present embodiment, the ratio of the linear velocity of the cleaning brush 8 to the linear velocity of the photoreceptor 3 at the time of the non-print job is in the range of 0.1 to 0.9. If the ratio of the linear velocity of the cleaning brush 8 to the linear velocity of the photoreceptor 3 is smaller than 0.1, the transfer residual toner caught by the cleaning brush 8 is not discharged to substantially the same place only. If the ratio between the linear velocities is larger than 0.9, the cleaning brush 8 rotates so fast that the time period in which the transfer residual toner is discharged from the cleaning brush 8 becomes short. Therefore, by setting the ratio between the linear velocities to 0.1 through 0.9 as in the present embodiment, the transfer residual toner can be discharged efficiently from the cleaning brush 8 onto the photoreceptor 3.

According to the present embodiment, if the cleaning member is a roller-shaped cleaning roller in which the outer peripheral portion thereof is configured by an elastic member, in the case of, for example, recovering the transfer residual toner from the charging roller 4 to the cleaning roller by means of an electrostatic force and a frictional force, the cleaning roller and the charging roller 4 are brought into contact with each other until the surface of the cleaning roller is elastically deformed and collapsed, and thereby a large frictional force can be obtained. Therefore, the transfer residual toner can be recovered from the charging roller 4 to the cleaning brush 8. Note that when cleaning the photoreceptor 3, the transfer residual toner can be recovered efficiently from the photoreceptor 3 to the cleaning brush 8 for the same reasons.

According to the present embodiment, it is preferred to use urethane form as the elastic member, because the indented urethane foam surface can easily scrape the transfer residual toner adhered to the photoreceptor 3 and the charging roller 4.

According to the present embodiment, because the cleaning member is the brush-shaped cleaning brush 8, when the brush rubs the photoreceptor 3 and the charging roller 4, the transfer residual toner can be scraped off of the photoreceptor 3 and the charging roller 4 by the cleaning brush 8 effectively.

According to the present embodiment, there is provided the conductive sheet 10 serving as toner charging means for abutting against the cleaning brush 8 to charge the toner recovered by the cleaning brush 8. Accordingly, the transfer residual toner caught by the cleaning brush 8 can be charged uniformly to the regular polarity at the same charge amount, hence the transfer residual toner can be discharged efficiently from the cleaning brush 8 to the photoreceptor 3 or the charging roller 4 by means of electrostatic force.

Moreover, according to the present embodiment, the image forming apparatus is further provided with: the primary transfer portion 69 serving as a transfer portion for transferring a toner image formed on the photoreceptor 3 to a transfer material; and the conductive sheet 11 serving as the toner charging means for charging the toner adhered to the surface of the photoreceptor 3 which is located on the upstream side in the photoreceptor rotation direction in relation to the position of abutment between the cleaning brush 8 and the photoreceptor 3 and also located between the cleaning brush 8 and the primary transfer portion 69. Accordingly, the transfer residual toner on the surface of the photoreceptor 3 is charged uniformly to the regular polarity at the same charge amount. Therefore, the transfer residual toner on the surface of the surface of the photoreceptor 3 is caught efficiently by the cleaning brush 8 using the electric force. Moreover, because the transfer residual toner caught by the cleaning brush 8 is uniformly charged to the regular polarity at the same charge amount by the conductive sheet 11 prior to being caught by the cleaning brush 8, the transfer residual toner can be discharged efficiently from the cleaning brush 8 to the photoreceptor 3 or the charging roller 4.

It should be noted in the present embodiment that a one-component developer that has a toner with a negative polarity as a main component is used as the developer, but a one-component developer that has a toner with a positive polarity as a main component may be used. In this case, a bias to be applied to each member may be charged to a polarity opposite to the negative polarity of the toner. In addition, not only the one-component developer having a toner as a main component, but also a two-component toner consisting of a toner and a magnetic carrier may be used.

It should be noted in the above descriptions that the expression, "non-image area," means an area on the surface of the latent image carrier in which an image is not formed until the latent image carrier surface to which the toner is discharged rotates once starting from the place where the toner is discharged to the latent image carrier surface.

As described above, the present invention has the excellent effect of maintaining the cleaning performance of the cleaning member and downsizing the apparatus main body.

Various modifications will become possible for those skilled in the art after receiving the teachings of the present disclosure without departing from the scope thereof.

What is claimed is:

1. An image forming apparatus, comprising:

a latent image carrier that carries a latent image on an endlessly moving surface thereof;

a developing means for developing the latent image carried on the latent image carrier by means of a toner;

a charging member that uniformly charges the surface of the latent image carrier while moving a surface of the charging member in contact with the latent image carrier;

a first bias supply means for supplying a bias to the charging member;

a cleaning member that recovers at least toners adhered to the surfaces of the latent image carrier and the charging member, while moving a surface of the cleaning member in contact with the latent image carrier and the charging member on an upstream side in a latent image carrier rotational direction in relation to the charging member, to clean the surfaces of the latent image carrier and the charging member; and a second bias supply means for supplying a bias to the cleaning member, wherein at least one of the following is performed:

supplying a bias from the second bias supply means to the cleaning member to transfer the toners from the cleaning member to a non-image area on the latent image carrier surface such as to transfer the toners directly from the cleaning member to the non-image area by means of an electrostatic force, the toners being recovered from the latent image carrier and the charging member to the cleaning member; and supplying a bias from the first bias supply means to the charging member, and supplying a bias from the second bias supply means to the cleaning member, to transfer the recovered toners from the cleaning member to the non-image area such as to transfer the toners from the cleaning member to the non-image area via the charging member, and wherein the toners that are transferred to the non-image area are recovered by the developing means.

2. The image forming apparatus as claimed in claim 1, wherein when the recovered toners are not transferred to the non-image area, the first bias supply means supplies a bias to the charging member, and the second bias supply means supplies a bias to the cleaning member, to transfer the toners from the latent image carrier and the charging member to the cleaning member, to transfer the toners adhered to the surfaces of the latent image carrier and the charging member to the cleaning member by means of an electrostatic force.

3. The image forming apparatus as claimed in claim 2, wherein the toner is charged to a negative polarity, when the recovered toners are not transferred to the non-image area, the first bias supply means supplies a bias to the charging member, and the second bias supply means supplies a bias to the cleaning member, such that a potential of the cleaning member becomes higher than a potential of the charging member and a potential of the latent image carrier, and when the recovered toners are transferred to the non-image area, the first bias supply means supplies a bias to the charging member, and the second bias supply means supplies a bias to the cleaning member, such that the potential of the cleaning member becomes lower than the potential of the charging member and the potential of the latent image carrier, and such that the potential of the charging member becomes lower than the potential of the latent image carrier.

4. The image forming apparatus as claimed in claim 1, wherein the second bias supply means supplies a bias obtained by superimposing an AC voltage on a DC voltage, to the cleaning member.

5. The image forming apparatus as claimed in claim 4, wherein the frequency of the AC voltage is 5 Hz through 500 Hz.

6. The image forming apparatus as claimed in claim 1, wherein the directions of rotation of the charging member and the cleaning member when transferring at least the recovered toners to the non-image area follow the direction of rotation of the latent image carrier.

7. The image forming apparatus as claimed in claim 1, wherein the ratio of a linear velocity of the cleaning member to a linear velocity of the latent image carrier when transferring the recovered toners to the non-image area is 0.1 through 0.9.

8. The image forming apparatus as claimed in claim 1, wherein the cleaning member has a roller shape, an outer peripheral portion of which is configured from an elastic member.

9. The image forming apparatus as claimed in claim 8, wherein the elastic member is urethane foam.

10. The image forming apparatus as claimed in claim 1, wherein the cleaning member has a brush shape.

11. The image forming apparatus as claimed in claim 1, further comprising a toner charging means that comes into contact with the cleaning member to charge the toners recovered by the cleaning member.

12. The image forming apparatus as claimed in claim 1, further comprising:

a transfer portion that transfers a toner image formed on the latent image carrier to a transfer material; and a toner charging means for charging the toner adhered to the surface of the latent image carrier located on the upstream side in the latent image carrier rotational direction in relation to a position of abutment between the cleaning member and the latent image carrier and located between the cleaning member and the transfer portion.

13. An image forming apparatus, comprising:

a latent image carrier that carries a latent image on an endlessly moving surface thereof;

a developing device for developing the latent image carried on the latent image carrier by means of a toner;

a charging member that uniformly charges the surface of the latent image carrier while moving a surface of the charging member in contact with the latent image carrier;

a first bias supply device for supplying a bias to the charging member;

a cleaning member that recovers at least toners adhered to the surfaces of the latent image carrier and the charging member, while moving a surface of the cleaning member in contact with the latent image carrier and the charging member on an upstream side in a latent image carrier rotational direction in relation to the charging member, to clean the surfaces of the latent image carrier and the charging member; and a second bias supply device for supplying a bias to the cleaning member, wherein at least one of the following is performed:

supplying a bias from the second bias supply device to the cleaning member to transfer the toners from the cleaning member to a non-image area on the latent image carrier surface such as to transfer the toners directly from the cleaning member to the non-image area by means of an electrostatic force, the toners being recovered from the latent image carrier and the charging member to the cleaning member; and supplying a bias from the first bias supply means to the charging member, and supplying a bias from the second bias supply means to the cleaning member, to transfer the recovered toners from the cleaning member to the non-image area such as to transfer the toners from the cleaning member to the non-image area via the charging member, and wherein the toners that are transferred to the non-image area are recovered by the developing device.

14. The image forming apparatus as claimed in claim 13, wherein when the recovered toners are not transferred to the non-image area, the first bias supply device supplies a bias to the charging member, and the second bias supply device supplies a bias to the cleaning member, to transfer the toner from the latent image carrier and the charging member to the cleaning member, to transfer the toner adhered to the surfaces of the latent image carrier and the charging member to the cleaning member by means of an electrostatic force.

15. The image forming apparatus as claimed in claim 14, wherein the toner is charged to a negative polarity, when the recovered toner is not transferred to the non-image area, the first bias supply device supplies a bias to the charging member, and the second bias supply device supplies a bias to the cleaning member, such that a potential of the cleaning member becomes higher than a potential of the charging member and a potential of the latent image carrier, and when the recovered toner is transferred to the non-image area, the first bias supply device supplies a bias to the charging member, and the second bias supply device supplies a bias to the cleaning member, such that the potential of the cleaning member becomes lower than the potential of the charging member and the potential of the latent image carrier, and such that the potential of the charging member becomes lower than the potential of the latent image carrier.

16. The image forming apparatus as claimed in claim 13, wherein the second bias supply device supplies a bias obtained by superimposing an AC voltage on a DC voltage, to the cleaning member.

17. The image forming apparatus as claimed in claim 16, wherein the frequency of the AC voltage is 5 Hz through 500 Hz.

18. The image forming apparatus as claimed in claim 13, wherein the directions of rotation of the charging member and the cleaning member when transferring at least the recovered toner to the non-image area follow the direction of rotation of the latent image carrier.

19. The image forming apparatus as claimed in claim 13, wherein the ratio of a linear velocity of the cleaning member to a linear velocity of the latent image carrier when transferring the recovered toner to the non-image area is 0.1 through 0.9.

20. The image forming apparatus as claimed in claim 13, further comprising:

a transfer portion that transfers a toner image formed on the latent image carrier to a transfer material; and a toner charging device to charge the toner adhered to the surface of the latent image carrier located on the upstream side in the latent image carrier rotational direction in relation to a position of abutment between the cleaning member and the latent image carrier and located between the cleaning member and the transfer portion.

* * * * *